US010856713B2

(12) United States Patent
Asahi et al.

(10) Patent No.: US 10,856,713 B2
(45) Date of Patent: Dec. 8, 2020

(54) CLEANER HEAD FOR VACUUM CLEANER, AND VACUUM CLEANER

(71) Applicants: Mitsubishi Electric Corporation, Tokyo (JP); Mitsubishi Electric Home Appliance Co., Ltd., Fukaya (JP)

(72) Inventors: Yohei Asahi, Tokyo (JP); Koshiro Takano, Tokyo (JP); Marika Haramaki, Tokyo (JP); Kimiyoshi Soma, Saitama (JP)

(73) Assignees: Mitsubishi Electric Corporation, Tokyo (JP); Mitsubishi Electric Home Appliance Co., Ltd., Fukaya (JP)

( * ) Notice: Subject to any disclaimer, the term of this patent is extended or adjusted under 35 U.S.C. 154(b) by 487 days.

(21) Appl. No.: 15/755,740

(22) PCT Filed: Oct. 22, 2015

(86) PCT No.: PCT/JP2015/079801
§ 371 (c)(1),
(2) Date: Feb. 27, 2018

(87) PCT Pub. No.: WO2017/068679
PCT Pub. Date: Apr. 27, 2017

(65) Prior Publication Data

US 2018/0242805 A1 Aug. 30, 2018

(51) Int. Cl.
*A47L 9/24* (2006.01)
*A47L 9/04* (2006.01)
(Continued)

(52) U.S. Cl.
CPC ..... *A47L 9/242* (2013.01); *A47L 5/362* (2013.01); *A47L 9/0411* (2013.01);
(Continued)

(58) Field of Classification Search
CPC ..... A47L 9/0477
See application file for complete search history.

(56) References Cited

U.S. PATENT DOCUMENTS

2004/0020005 A1 2/2004 Odachi et al.
2016/0256025 A1* 9/2016 Van Der Kooi ..... A47L 11/24

FOREIGN PATENT DOCUMENTS

CN 101036565 A 9/2007
JP 59-105456 U1 7/1984
(Continued)

OTHER PUBLICATIONS

Taiwan Office Action dated Apr. 13, 2017 in the corresponding TW application No. 104137122. (with English translation).
(Continued)

*Primary Examiner* — Andrew A Horton
(74) *Attorney, Agent, or Firm* — Posz Law Group, PLC

(57) ABSTRACT

A cleaner head for a vacuum cleaner includes: a body having a proximal end and a distal end; an agitator, an axis of rotation R1 of the agitator being substantially parallel to a longitudinal direction of the body; a motor configured to cause the agitator to rotate; and a joint configured to turnably connect a suction pipe to the body. The joint is positioned closer to the proximal end than to the distal end. The body includes a second suction channel configured to communicate with a first suction channel inside the joint, and a bulkhead configured to separate an agitator chamber and the second suction channel from each other. The second suction channel extends substantially parallel to the axis of rotation of the agitator. The bulkhead includes at least one air vent from the agitator chamber to the second suction channel.

14 Claims, 23 Drawing Sheets

(51) Int. Cl.
*A47L 5/36* (2006.01)
*A47L 9/28* (2006.01)

(52) U.S. Cl.
CPC ..... *A47L 9/0444* (2013.01); *A47L 9/0477* (2013.01); *A47L 9/248* (2013.01); *A47L 9/2857* (2013.01)

(56) References Cited

FOREIGN PATENT DOCUMENTS

| | | | |
|---|---|---|---|
| JP | 63-267323 | A | 11/1988 |
| JP | 08-038400 | A | 2/1996 |
| JP | 2004-105275 | A | 4/2004 |
| JP | 2004-329601 | A | 11/2004 |
| JP | 2006-334301 | A | 12/2006 |
| JP | 5141533 | A1 | 7/2010 |
| JP | 2013-070838 | A | 4/2013 |
| JP | 2013-132475 | A | 7/2013 |
| JP | 2015-051071 | A | 3/2015 |

OTHER PUBLICATIONS

International Search Report of the International Searching Authority dated Jan. 19, 2016 for the corresponding international application No. PCT/JP2015/079801 (and English translation).
Written Opinion of the International Searching Authority dated Jan. 19, 2016 for the corresponding international application No. PCT/JP2015/079801.
Office Action dated May 6, 2020 issued in corresponding CN patent application No. 201580083864.7 (and English translation).
Office Action dated Dec. 3, 2019 issued in corresponding CN patent application No. 201580083864.7 (and English translation).
Office Action dated Oct. 29, 2018 issued in corresponding Australian Patent Application No. 2015412294.
English translation of the International Preliminary Report on Patentability dated May 3, 2018.

* cited by examiner

CLEANER HEAD FOR VACUUM CLEANER, AND VACUUM CLEANER

CROSS REFERENCE TO RELATED APPLICATION

This application is a U.S. national stage application of International Application No. PCT/JP2015/079801 filed on Oct. 22, 2015, the disclosure of which is incorporated herein by reference.

TECHNICAL FIELD

The present invention relates to a cleaner head for a vacuum cleaner and to a vacuum cleaner.

BACKGROUND ART

PTL 1 cited below describes a vacuum cleaner including a connection tube communicated with a suction hose, a suction port body in which a suction port is formed, and a coupling portion which couples the suction port body to the connection tube.

CITATION LIST

Patent Literature

[PTL 1] Japanese Patent No. 5141533

SUMMARY OF INVENTION

Technical Problem

The vacuum cleaner described in PTL 1 has the following problem. The coupling portion is arranged at center in a longitudinal direction of the suction port body in a plan view. For example, when the suction port body is inserted from one end in the longitudinal direction thereof into a narrow gap formed between, pieces of furniture, the coupling portion may become an obstacle and prevent the suction port body from being inserted beyond the coupling portion. In such a case, the suction port body can only be inserted into the gap by less than half of its length in the longitudinal direction.

The present invention has been made in order to solve the problem described above and an object thereof is to provide a cleaner head for a vacuum cleaner capable of readily and efficiently cleaning both wide and narrow spaces and a vacuum cleaner including the cleaner head.

Solution to Problem

A cleaner head for a vacuum cleaner according to the present invention includes: a body having a proximal end and a distal end, a length from the proximal end to the distal end being longer than a width perpendicular to a longitudinal direction from the proximal end toward the distal end; an agitator rotatably mounted relative to the body, an axis of rotation of the agitator being substantially parallel to the longitudinal direction; a motor configured to rotate the agitator, a suction pipe; and a joint having a first suction channel in communication with an inside of the suction pipe, the joint being configured to turnably connect the suction pipe to the body, the joint being located closer to the proximal end than to the distal end, the body including an agitator chamber housing the agitator, a second suction channel in communication with the first suction channel, and a bulkhead separating the agitator chamber from the second suction channel, the second suction channel extending substantially parallel to the axis of rotation of the agitator, the bulkhead having at least one air vent from the agitator chamber to the second suction channel.

A vacuum cleaner according to the present invention includes the cleaner head described above.

Advantageous Effects of Invention

According to the present invention, due to the joint, configured to turnably connect the suction pipe to the body of the cleaner head for the vacuum cleaner, being positioned closer to the proximal end than to the distal end of the body, both wide and narrow spaces can be cleaned readily and efficiently. In addition, due to the bulkhead, configured to separate the second suction channel extending substantially parallel to the axis of rotation of the agitator and the agitator chamber from each other, having the at least one air vent, an unevenness of a suction amount of a suction opening can be prevented.

DESCRIPTION OF EMBODIMENTS

Figure 1:
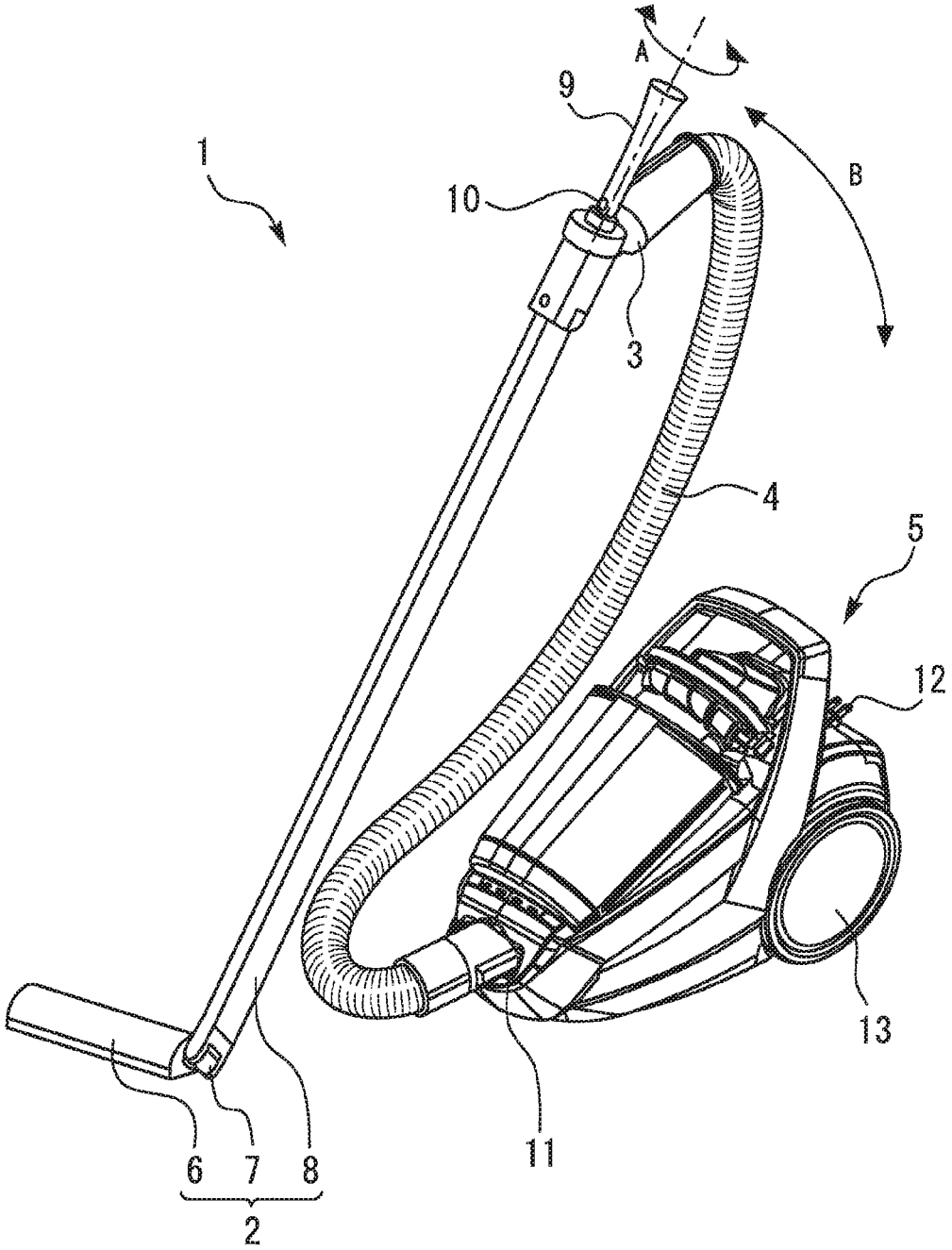
FIG. 1 is a perspective view of a vacuum cleaner including a cleaner head according to a first embodiment.

Hereinafter, embodiments of the present invention will be described with reference to the drawings. Note that common elements in the drawings are denoted by same reference signs and overlapping descriptions will be simplified or omitted. Moreover, generally, the numbers, arrangements, orientations, shapes, and sizes of apparatuses, instruments, parts, and the like according to the present invention are not limited to the numbers, arrangements, orientations, shapes, and sizes depicted in the drawings. In addition, the present invention may include all possible combinations of combinable configurations among the configurations described in the respective embodiments below.

First Embodiment

FIG. 1 is a perspective view of a vacuum cleaner including a cleaner head according to a first embodiment. As shown in FIG. 1, a vacuum cleaner (an electric cleaner) 1 according to the first embodiment includes a cleaner head 2, a connection pipe 3, a suction hose 4, and a cleaner main body 5. The cleaner head 2 includes a body 6, a joint 7, and a suction pipe 8. A handle 9 with an operation switch 10 is coupled to the connection pipe 3. The cleaner main body 5 includes a hose connection port 1*l*, a power cord 12, and a wheel 13. The hose connection port 11 is positioned to the front of the cleaner main body 5. The wheel 13 is positioned on side surfaces on both sides of a rear-half portion of the cleaner main body 5.

The body 6 of the cleaner head 2 sucks in dust on a surface to be cleaned (hereinafter, referred to as a "surface to be cleaned") together with air. The joint 7 turnably connects the suction pipe 8 to the body 6. The suction pipe 8 is a straight tube-like member. One end of the suction pipe 8 is connected to the joint 7. Another end of the suction pipe 8 is connected to one end of the connection pipe 3.

The connection pipe 3 is a cylindrical member being bent midway. Another end of the connection pipe 3 is connected to one end of the suction hose 4. The suction hose 4 is a bellows member having flexibility. Another end of the suction hose 4 is connected to the hose connection port 11 of the cleaner main body 5. The cleaner main body 5 is for separating dust from air containing dust and discharging air from which dust has been removed. Hereinafter, air including dust will also be referred to as "dirty air". In addition, air from which dust has been removed will also be referred to as "clean air". For example, clean air is returned into a room from the cleaner main body 5.

When a user carries out cleaning using the vacuum cleaner 1, the user grips the handle 9. The handle 9 may be at least partially formed of a soft material such as a gel. The handle 9 may be formed of a material softer than the suction pipe 8. The handle 9 may have a rod shape. A central axis of the rod-like handle 9 may coincide with a central axis of the suction pipe 8. In FIG. 1, the central axis of the handle 9 and the central axis of the suction pipe 8 are indicated by a long dashed short dashed line. The handle 9 may be formed so that a cross-sectional area of a distal end part is greater than a cross-sectional area at center in a longitudinal direction. The handle 9 may be formed so that, in the longitudinal direction, a side further from the body 6 is thicker than a side closer to the body 6.

Both arrows shown in FIG. 1 indicate an example of how the handle 9 is moved. A movement in a twisting direction A is a rotation around the central axes of the handle 9 and the suction pipe 8. A movement in an inclination direction B is a movement that changes angles of the handle 9 and the suction pipe 8 relative to a floor surface.

The operation switch 10 is provided at a position near a base of the handle 9. The operation switch 10 is used by the user to control operations of the vacuum cleaner 1.

The power cord 12 is wound around a cord reel portion (not shown) inside the cleaner main body 5. As will be described later, an electric air blower is built into the cleaner main body 5. When the power cord 12 is connected to an external power source, power is supplied to internal devices including the electric air blower. The electric air blower is driven by supplying power thereto. The electric air blower performs a suction operation set in advance in accordance with an operation on the operation switch 10.

When the electric air blower performs a suction operation, dirty air is sucked into the body 6. The dirty air sucked into the body 6 passes inside the joint 7, the suction pipe 8, the connection pipe 3, and the suction hose 4 before being supplied to the cleaner main body 5. The body 6, the joint 7, the suction pipe 8, the connection pipe 3, and the suction hose 4 constitute an air channel that supplies dirty air to the cleaner main body 5.

Figure 2:
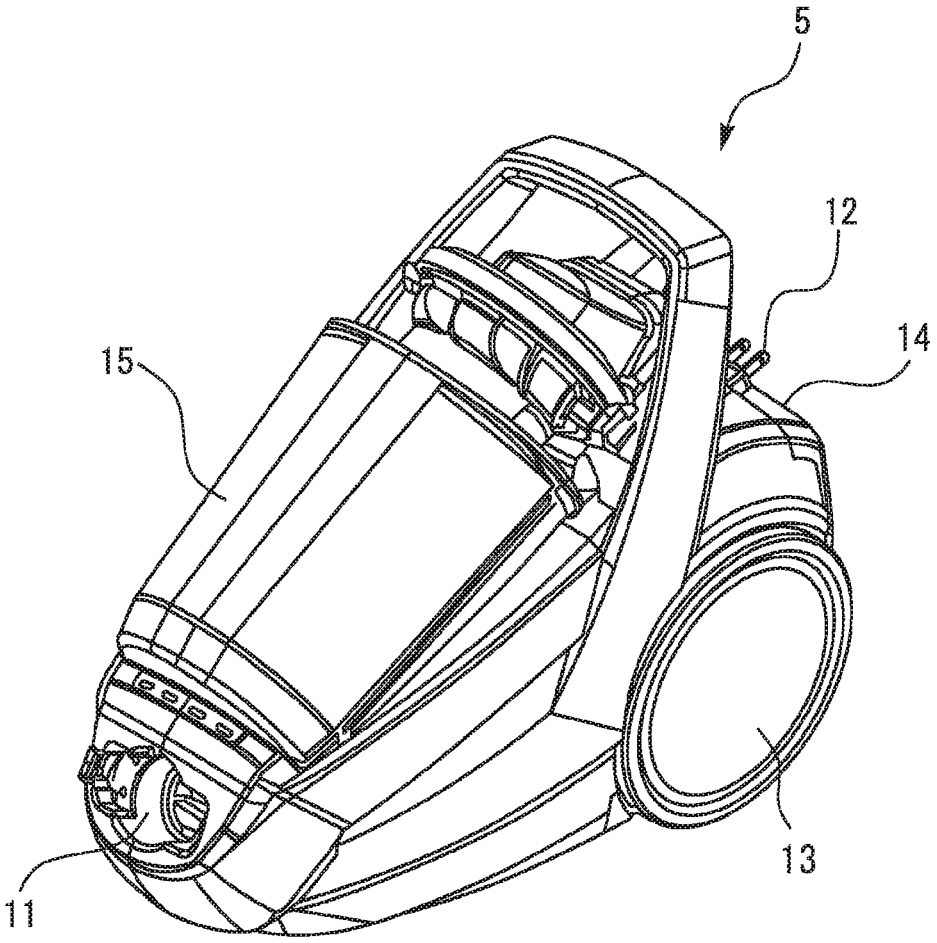
FIG. 2 is a perspective view of a cleaner main body according to the first embodiment.
Figure 3:
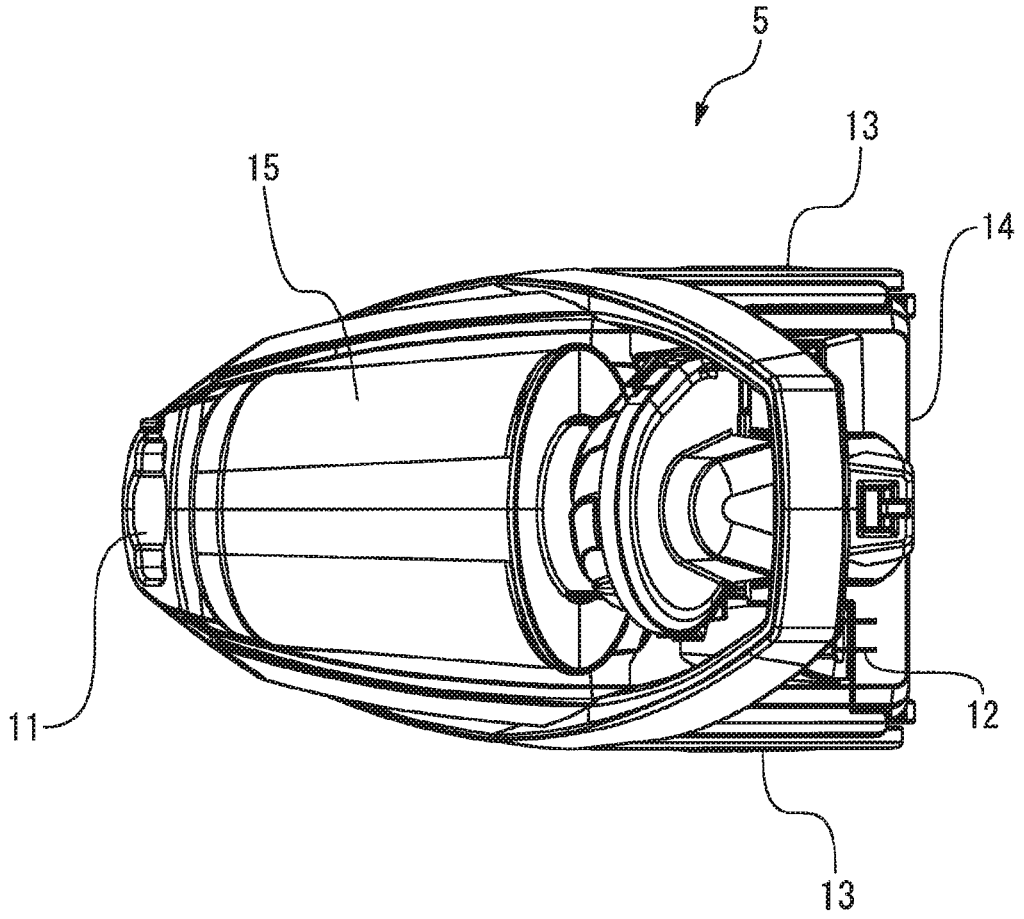
FIG. 3 is a plan view of the cleaner main body according to the first embodiment.

FIG. 2 is a perspective view of the cleaner main body 5 according to the first embodiment. FIG. 3 is a plan view of the cleaner main body 5 according to the first embodiment. As shown in FIGS. 2 and 3, the cleaner main body 5 includes a housing unit 14 and a dust collecting unit 15. The housing unit 14 houses various devices other than the dust collecting unit 15. The hose connection port 11 is formed in a front end portion of the housing unit 14. The wheel 13 is provided on side surfaces on both sides of a rear half of the housing unit 14. The dust collecting unit 15 is attachably and detachably mounted to the housing unit 14.

Figure 4:
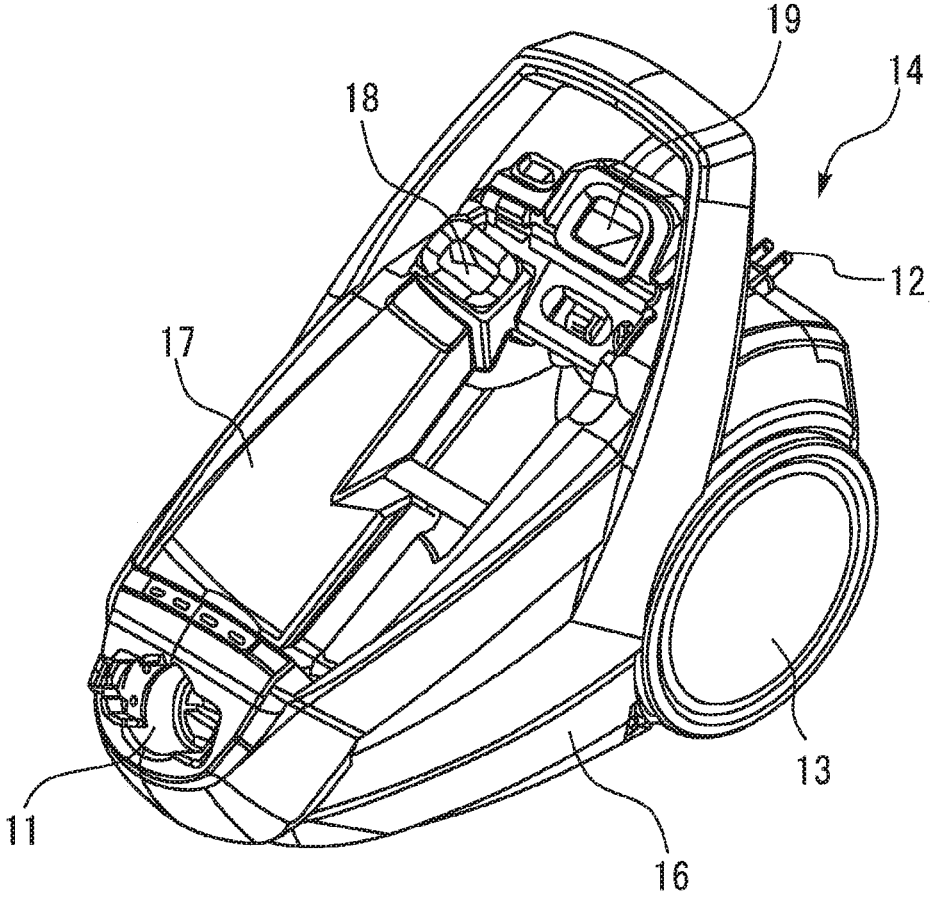
FIG. 4 is a perspective view of a housing unit according to the first embodiment.
Figure 5:
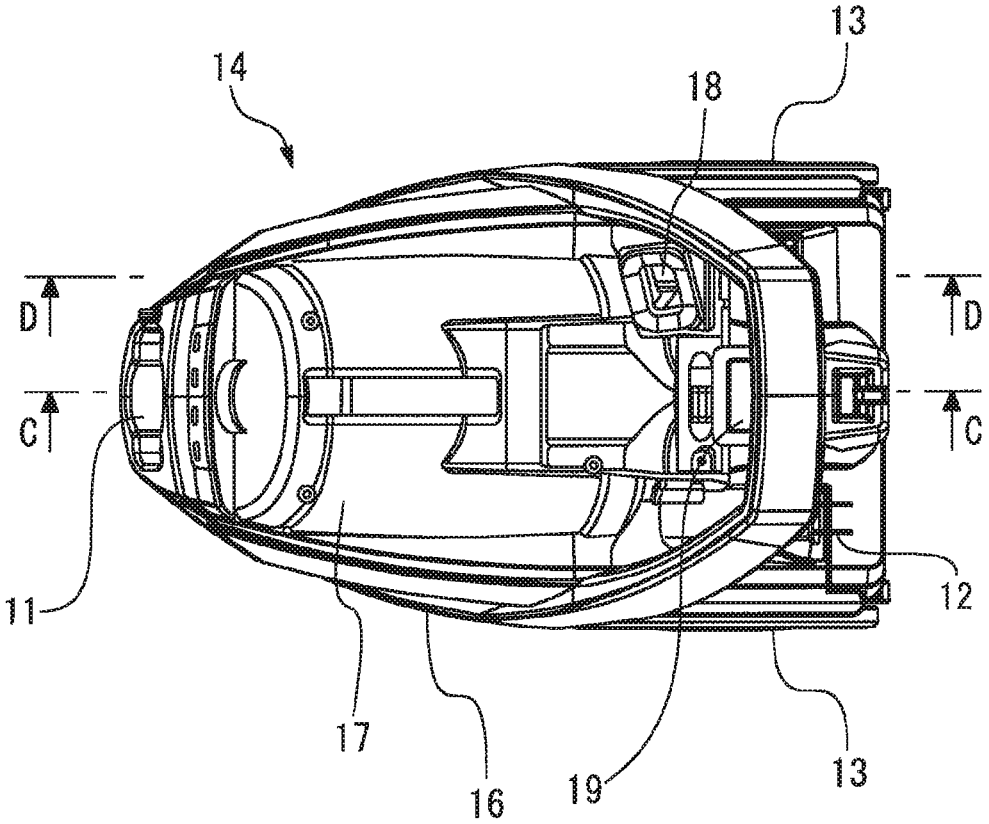
FIG. 5 is a plan view of the housing unit according to the first embodiment.

FIG. 4 is a perspective view of the housing unit 14 according to the first embodiment. FIG. 5 is a plan view of the housing unit 14 according to the first embodiment. FIGS. 4 and 5 show a state where the dust collecting unit 15 has been detached from the housing unit 14. As shown in FIGS. 4 and 5, the housing unit 14 includes a housing body 16 and a housing body 17.

The housing body 16 is a box-like member with an open upper part. The housing body 16 is, for example, a molded article. The electric air blower and the cord reel portion are housed inside the housing body 16. The housing body 17 is coupled to the housing body 16 so as to close the opening described above which is formed on the housing body 16. The housing body 17 includes a housing portion that is a space for housing the dust collecting unit 15. When the dust collecting unit 15 is appropriately mounted to the housing unit 14, a main portion of the dust collecting unit 15 is arranged in the housing portion. The dust collecting unit 15 is arranged above the housing body 17.

As shown in FIGS. 4 and 5, a first connection port 18 and a second connection port 19 are formed in the housing unit 14. The first connection port 18 and the second connection port 19 are arranged close to a rear end portion on an upper surface of the housing unit 14. The first connection port 18 is arranged close to one of the side surfaces of the housing unit 14. The second connection port 19 is arranged equidistantly from both side surfaces of the housing unit 14. The first connection port 18 and the second connection port 19 are communicated with an inside of the dust collecting unit 15 in a state where the dust collecting unit 15 is mounted to the housing unit 14.

Figure 6:
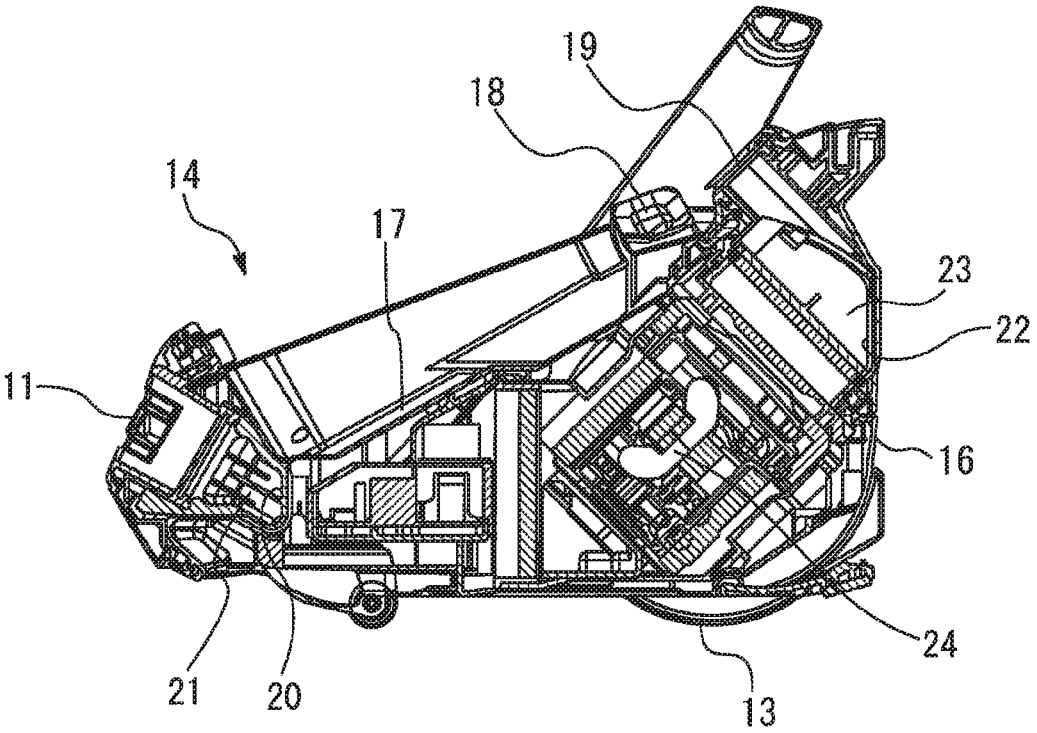
FIG. 6 is a cross-sectional view taken along line C-C of the housing unit shown in FIG. 5.
Figure 7:
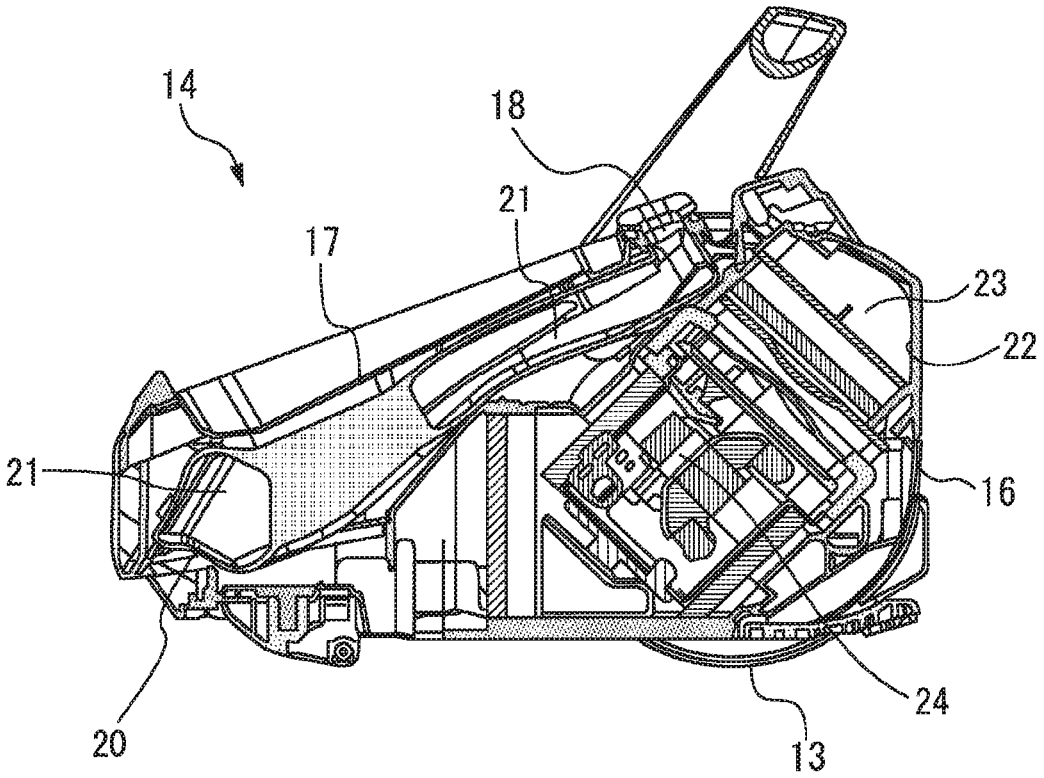
FIG. 7 is a cross-sectional view taken along line D-D of the housing unit shown in FIG. 5.

FIG. 6 is a cross-sectional view taken along line C-C of the housing unit 14 shown in FIG. 5. FIG. 7 is a cross-sectional view taken along line D-D of the housing unit 14 shown in FIG. 5. As shown in FIGS. 6 and 7, the housing unit 14 includes a suction air channel-forming portion 20. The suction air channel-forming portion 20 forms a suction air channel 21 for guiding dirty air to the dust collecting unit 15 in the cleaner main body 5. The suction air channel-forming portion 20 is provided so as to pass through an internal space of the housing body 16. One end of the suction air channel-forming portion 20 opens on a front surface of the housing unit 14. The one end of the suction air channel-forming portion 20 described above forms the hose connection port 11. Another end of the suction air channel-forming portion 20 opens on the upper surface of the housing unit 14. In other words, the other end of the suction air channel-forming portion 20 described above opens in the housing body 17. The other end of the suction air channel-forming portion 20 described above forms the first connection port 18 that is connected to the dust collecting unit 15.

The dust collecting unit 15 is for separating dust from dirty air and temporarily storing the separated dust. The dust collecting unit 15 separates dust from air using centrifugal force by causing dirty air to rotate inside the dust collecting unit 15. In other words, the dust collecting unit 15 is a cyclonic separator equipped with a cyclonic separation function.

As shown in FIGS. 6 and 7, the housing unit 14 includes an exhaust air channel-forming portion 22. The exhaust air channel-forming portion 22 forms an exhaust air channel 23 for guiding clean air discharged from the dust collecting unit 15 to an exhaust port (not shown) in the cleaner main body 5. The exhaust air channel-forming portion 22 is provided so as to pass through an internal space of the housing body 16. One end of the exhaust air channel-forming portion 22 opens on the upper surface of the housing unit 14. In other words, the one end of the exhaust air channel-forming portion 22 described above opens in the housing body 17. The one end of the exhaust air channel-forming portion 22 described above forms the second connection port 19 that is connected to the dust collecting unit 15. Another end of the exhaust air channel-forming portion 22 opens toward the outside of the housing unit 14. The other end of the exhaust air channel-forming portion 22 described above forms the exhaust port.

As shown in FIGS. 6 and 7, an electric air blower 24 is provided inside the housing unit 14. The electric air blower 24 is for generating an air flow in air channels formed in the vacuum cleaner 1. The air channels formed in the vacuum cleaner 1 refer to an air channel for allowing dirty air to flow into the cleaner main body 5 from the outside, the suction air channel 21, a space inside the dust collecting unit 15, and the exhaust air channel 23. The electric air blower 24 is arranged inside the exhaust air channel 23 at a position set in advance close to a rear end portion of the housing unit 14.

When the electric air blower 24 starts a suction operation, an air flow is generated in each air channel formed in the vacuum cleaner 1. At this point, a suction force is generated inside the cleaner head 2, the connection pipe 3, and the suction hose 4. Dirty air sucked into the body 6 of the cleaner head 2 is taken into the cleaner main body 5 from the hose connection port 11. The dirty air having flowed into the cleaner main body 5 passes through the suction air channel 21 and is supplied to the dust collecting unit 15 from the first connection port 18. Inside the dust collecting unit 15, dust is separated from the dirty air. Clean air discharged from the dust collecting unit 15 flows into the exhaust air channel 23 and passes through the electric air blower 24 inside the exhaust air channel 23. The clean air having passed through the electric air blower 24 proceeds further along the exhaust air channel 23 and is discharged to the outside of the cleaner main body 5 from the exhaust port.

Figure 8:
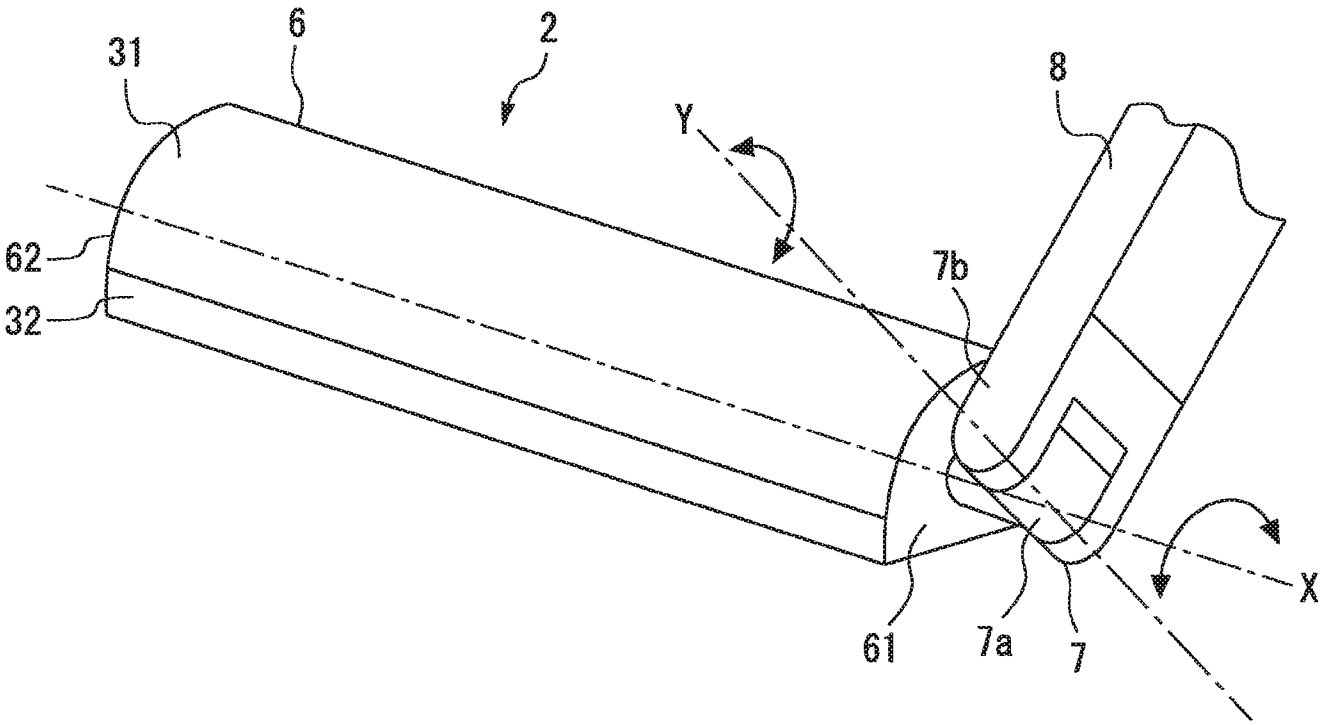
FIG. 8 is a perspective view of the cleaner head according to the first embodiment.
Figure 9:
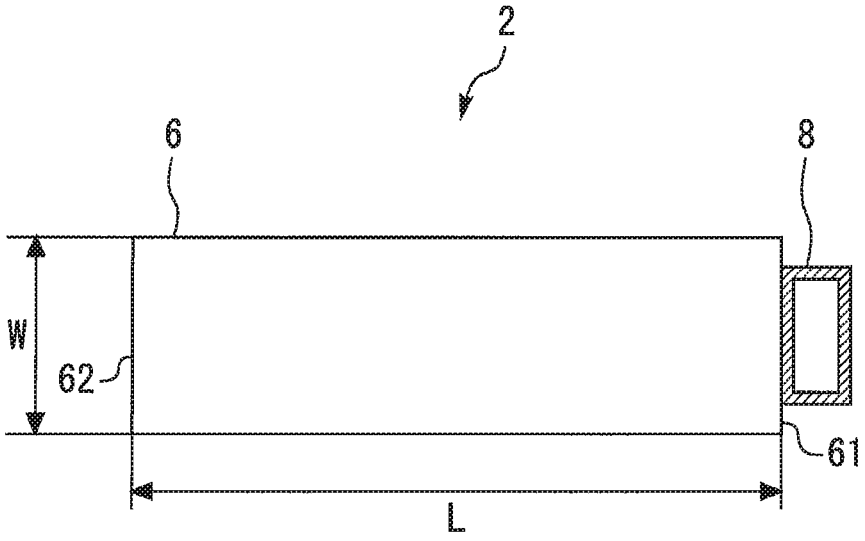
FIG. 9 is a plan view of the cleaner head according to the first embodiment.

FIG. 8 is a perspective view of the cleaner head 2 according to the first embodiment. FIG. 9 is a plan view of the cleaner head 2 according to the first embodiment. FIG. 9 shows a state where the suction pipe 8 is arranged perpendicular to the surface to be cleaned and the suction pipe 8 is cut at a midway position in the longitudinal direction.

As shown in FIG. 9, the body 6 of the cleaner head 2 has a proximal end 61 and a distal end 62. L denotes a length (a maximum length) from the proximal end 61 to the distal end 62. A direction from the proximal end 61 toward the distal end 62 will be referred to as a longitudinal direction of the body 6. W denotes a width (a maximum width) of the body 6. The width W represents a size of the body 6 in a direction perpendicular to the longitudinal direction of the body 6 in a plan view. The length L of the body 6 is longer than the width W of the body 6. In the present embodiment, a shape of the body 6 in a plan view is roughly rectangular. Hereinafter, the direction perpendicular to the longitudinal direction of the body 6 in a plan view will be referred to as a width direction of the body 6.

In the present embodiment, the proximal end 61 and the distal end 62 extend linearly in a plan view. In addition to such a configuration, the proximal end 61 and the distal end 62 may at least partially form a curved line or a broken line in a plan view. In this case, the length L of the body 6 is to refer to a maximum length in the longitudinal direction between the proximal end 61 and the distal end 62 in a plan view. In the present embodiment, the width of the body 6 is approximately constant along the longitudinal direction of the body 6. In addition to such a configuration, the width of the body 6 may vary along the longitudinal direction of the body 6. In this case, the width W of the body 6 is to refer to a maximum width of the body 6.

As shown in FIG. 8, a body 6 may include an upper case 31 and a lower case 32. A joint 7 according to the present embodiment includes a first section 7*a* and a second section 7*b*. The first section 7*a* is connected to the body 6 so as to be turnable around a first pivot axis X. The second section 7*b* is connected to the first section 7*a* so as to be turnable around a second pivot axis Y. The second pivot axis Y is not parallel to the first pivot axis X. In FIG. 8, the first pivot axis X and the second pivot axis Y are indicated by long dashed short dashed lines.

In the present embodiment, the first pivot axis X is substantially parallel to a longitudinal direction of the body 6. The second pivot axis Y is substantially perpendicular to the first pivot axis X. As an alternative to such a configuration, the second pivot axis Y may be substantially parallel to the longitudinal direction of the body 6 and the first pivot axis X may be substantially perpendicular to the second pivot axis Y.

In the present embodiment, the joint 7 is connected to an end surface of a proximal end 61 of the body 6. The first section 7*a* of the joint 7 is connected to the end surface of the proximal end 61 of the body 6 so as to be rotatable around the first pivot axis X.

In the present embodiment, the second section 7*b* of the joint 7 and a suction pipe 8 are integrally formed. In addition to such a configuration, the second section 7*b* of the joint 7 and the suction pipe 8 may be constituted by separate members and the two members may be attachably and detachably coupled to each other.

In the following description, a narrow gap formed between pieces of furniture and the like will be referred to as a "narrow space". In addition, a cleaner head having a joint at center in a longitudinal direction of a body of the cleaner head as in the case of conventional cleaner heads will be referred to as a "center joint head". With the present embodiment, the following effects are produced. A length from a distal end 62 of the body 6 to the joint 7 can be made longer than a length from an end of a body of a center joint head to a joint. When cleaning a narrow space of which a width is equal to or greater than a width W of the body 6, by inserting the body 6 into the narrow space from a side of the distal end 62, the body 6 can be inserted deeper as compared to a center joint head. Thus, the narrow space can be readily cleaned. A radius of rotation when rotating the body 6 around the joint 7 in a plan view becomes longer as compared to a center joint head. A length of the body 6 in the longitudinal direction can be efficiently used. A cleaning range when rotating the body 6 can be expanded and cleaning can be performed efficiently in a short period of time.

With the present embodiment, since the joint 7 is connected to an end surface of the proximal end 61 of the body 6, the body 6 can be inserted deeper into the narrow space. Thus, the narrow space can be particularly readily cleaned.

In the present invention, the joint 7 need not be connected to an end surface of the proximal end 61 of the body 6. In the present invention, the joint 7 need only be positioned closer to the proximal end 61 than to the distal end 62. In other words, the joint 7 may be arranged at a position biased to a side of the proximal end 61 than to a center of the body 6 in the longitudinal direction. When the joint 7 is at a position that is closer to the proximal end 61 than to the distal end 62, the body 6 can be inserted deeper into the narrow space as compared to a center joint head.

While an orientation of the second pivot axis Y changes as the first section 7*a* of the joint 7 rotates around the first pivot axis X, the second pivot axis Y is maintained perpendicular to the first pivot axis X. The first section 7*a* is rotatable around the first pivot axis X within an angular range set in advance with respect to the body 6. The second section 7*b* of the joint 7 is rotatable around the second pivot axis Y within an angular range set in advance with respect to the first section 7*a*.

Figure 10:
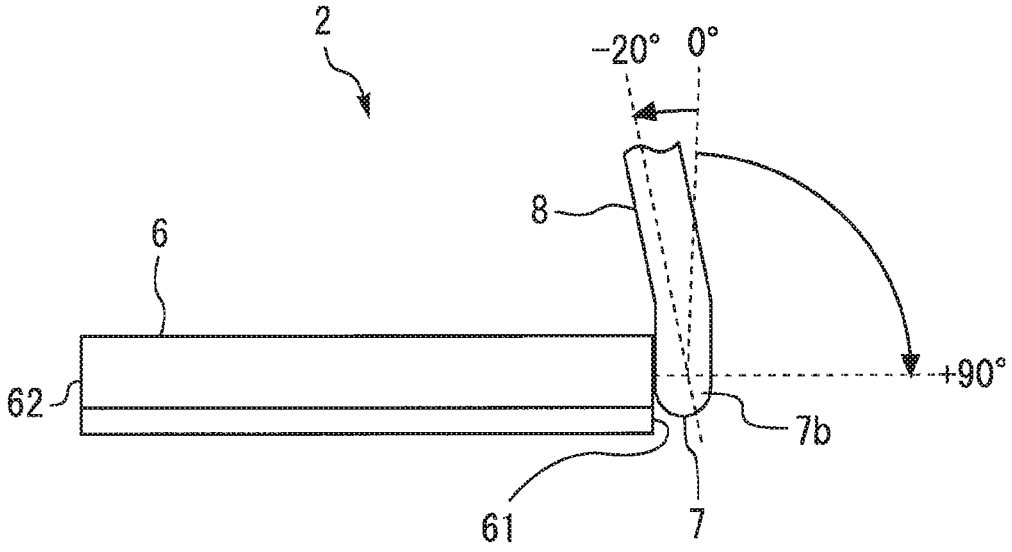
FIG. 10 is a side view of the cleaner head according to the first embodiment as seen from a direction parallel to a width direction of a body.

FIG. 10 is a side view of a cleaner head 2 according to the first embodiment as seen from a direction parallel to a width direction of the body 6. Both arrows in FIG. 10 indicate an example of an angular range within which the second section 7*b* of the joint 7 is rotatable around the second pivot axis Y with respect to the first section 7*a*. In the example shown in FIG. 10, when a state where an axial direction of the suction pipe 8 equals a vertical direction is considered 0°, the axial direction of the suction pipe 8 can rotate within a range of −20° to +90°. In the following description, an angle defined in this manner will be referred to as "an angle of rotation of the second pivot axis Y". Moreover, as shown in FIG. 10, the axial direction of the suction pipe 8 may be inclined with respect to an axial direction of the second section 7*b* of the joint 7. Alternatively, the axial direction of the suction pipe 8 may be parallel to or coaxial with the axial direction of the second section 7*b* of the joint 7.

Figure 11:
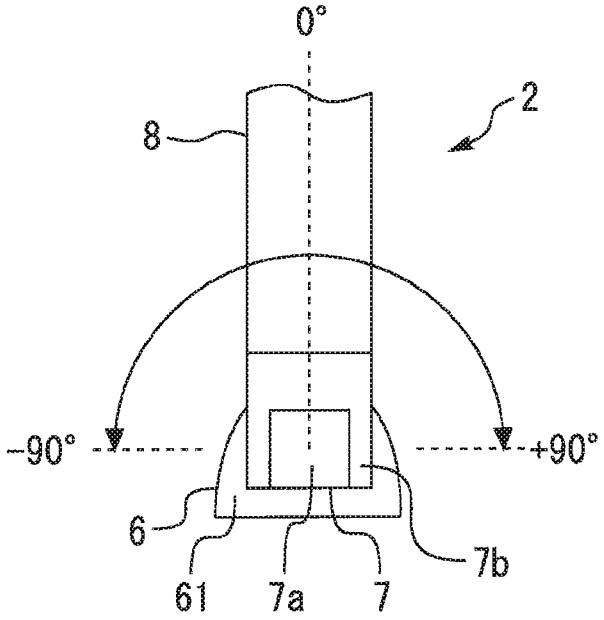
FIG. 11 is a side view of the cleaner head according to the first embodiment as seen from a direction parallel to a longitudinal direction of the body.

FIG. 11 is a side view of the cleaner head 2 according to the first embodiment as seen from a direction parallel to the longitudinal direction of the body 6. Both arrows in FIG. 11 indicate an example of an angular range within which the first section 7*a* of the joint 7 is rotatable around the first pivot axis X with respect to the body 6. In the example shown in FIG. 11, when a state where the axial direction of the suction pipe 8 equals a vertical direction is considered 0°, the axial direction of the suction pipe 8 can rotate within a range of −90° to +90°. In the following description, an angle defined in this manner will be referred to as "an angle of rotation of the first pivot axis X".

FIGS. 9 to 11 show a state where the angle of rotation of the first pivot axis X is 0°. As shown in FIGS. 9 and 11, in a state where the angle of rotation of the first pivot axis X is 00, sizes of the joint 7 and the suction pipe 8 along the width direction of the body 6 are smaller than a maximum width W of the body 6.

Figure 12:
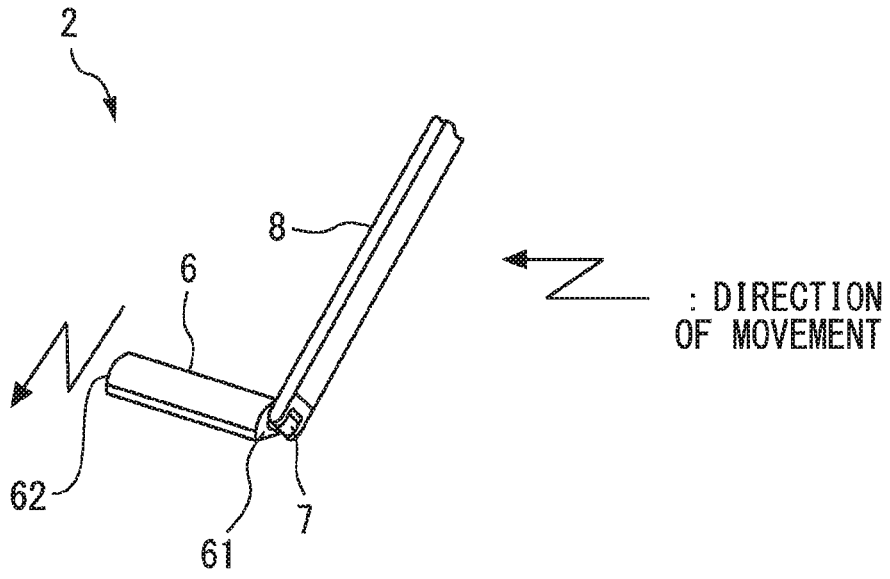
FIG. 12 is a perspective view showing a mode of use of the cleaner head according to the first embodiment.
Figure 13:
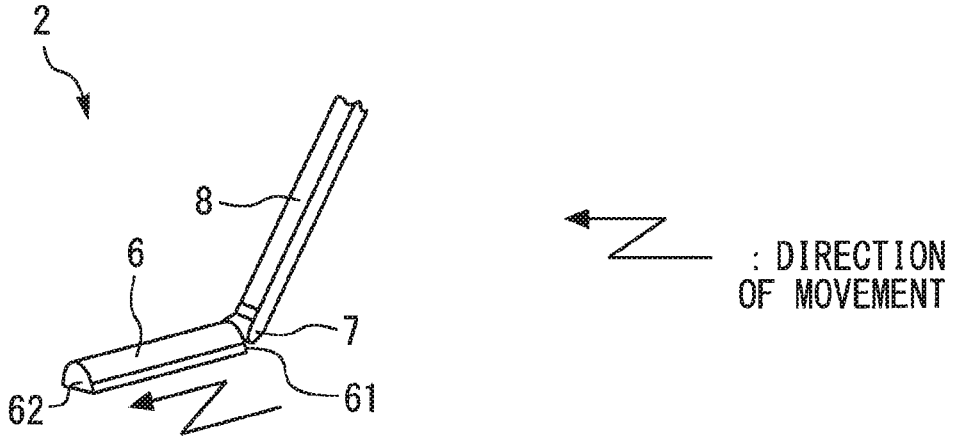
FIG. 13 is a perspective view showing another mode of use of the cleaner head according to the first embodiment.

FIG. 12 is a perspective view showing a mode of use of the cleaner head 2 according to the first embodiment. FIG. 13 is a perspective view showing another mode of use of the cleaner head 2 according to the first embodiment. FIG. 12 shows a mode of use in which the body 6 is moved along the width direction. FIG. 13 shows a mode of use in which the body 6 is moved along the longitudinal direction. Hereinafter, the mode of use shown in FIG. 12 will also be referred to as an "L-shape-mode" and the mode of use shown in FIG. 13 will also be referred to as an "I-shape-mode".

When carrying out cleaning using the vacuum cleaner 1, a user can operate an orientation of the body 6 of the cleaner head 2 with a hand holding a handle 9. For example, when the handle 9 is rotated in a twisting direction A shown in FIG. 1, the joint 7 rotates and the orientation of the body 6 changes. By twisting the handle 9, the user can change an orientation of the body 6 when the body 6 is moved back and forth as viewed from the user. In this case, for example, the orientation of the body 6 can be changed between the L-shape-mode and the I-shape-mode. Setting the orientation of the body 6 to the L-shape-mode enables a wide space to be readily cleaned. Setting the orientation of the body 6 to the I-shape-mode enables a narrow space such as a narrow space to be readily cleaned. When the orientation of the body 6 changes between the L-shape-mode and the I-shape-mode, the body 6 can rotate without being separated from a surface to be cleaned. In the present embodiment, a radius of rotation of the body 6 at this point is approximately the same as a length L of the body 6 in a plan view.

With the present embodiment, the following effects are produced. The mode of use of the cleaner head 2 can be changed between the L-shape-mode and the I-shape-mode depending on circumstances. For example, when cleaning a wide space such as a center of a room, the cleaner head 2 can be used in the L-shape-mode. For example, when cleaning a narrow space such as a gap between pieces of furniture, the cleaner head 2 can be used in the I-shape-mode. By simply changing the orientation of the body 6, cleaning of a wide variety of scenes including wide spaces and narrow spaces can be accommodated. Since the need to remove and replace attachments suitable for a place to be cleaned can be reduced, a burden on the user can be eased.

Figure 14:
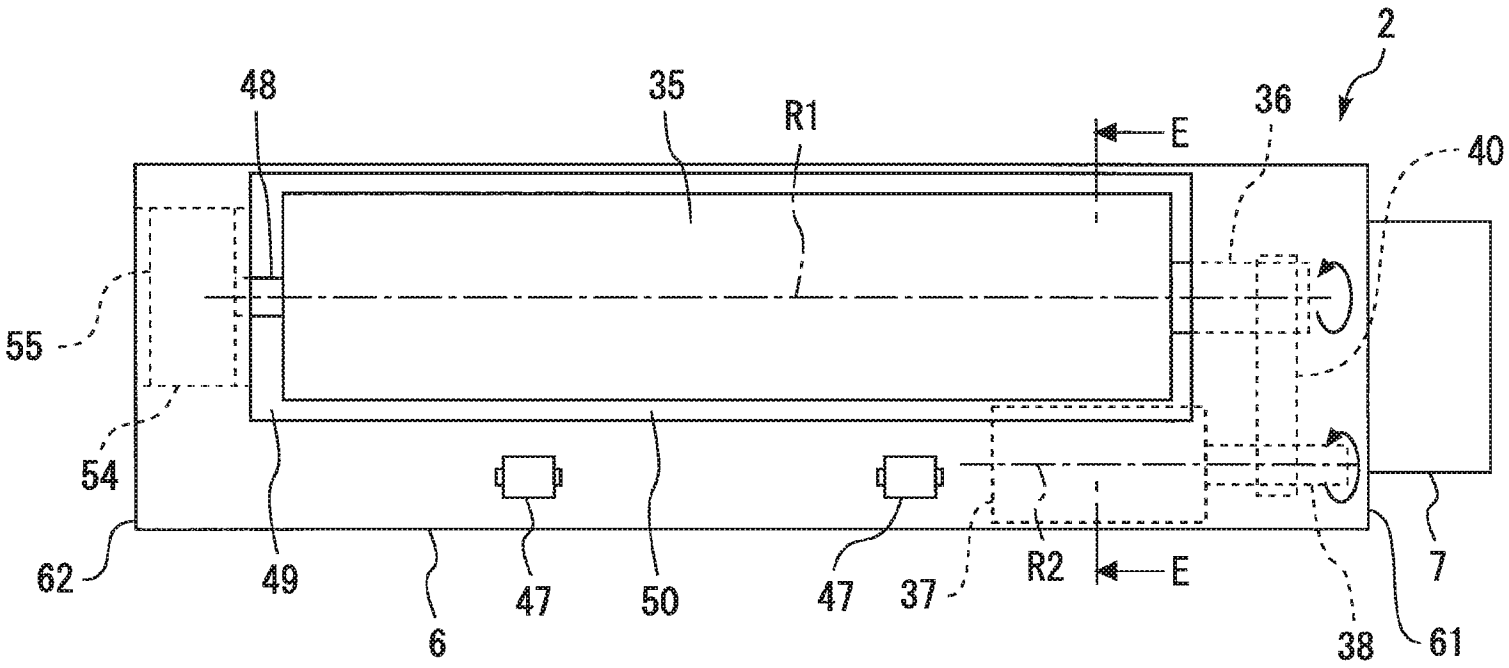
FIG. 14 is a bottom view of the cleaner head according to the first embodiment.
Figure 15:
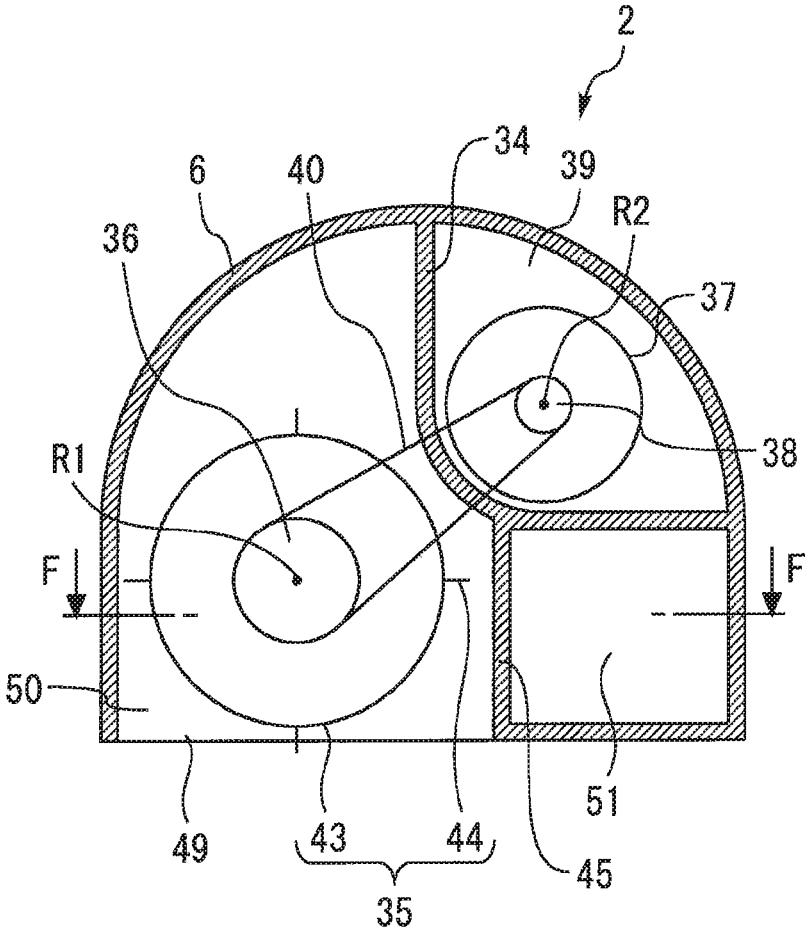
FIG. 15 is a cross-sectional view taken along line E-E in FIG. 14.
Figure 16:
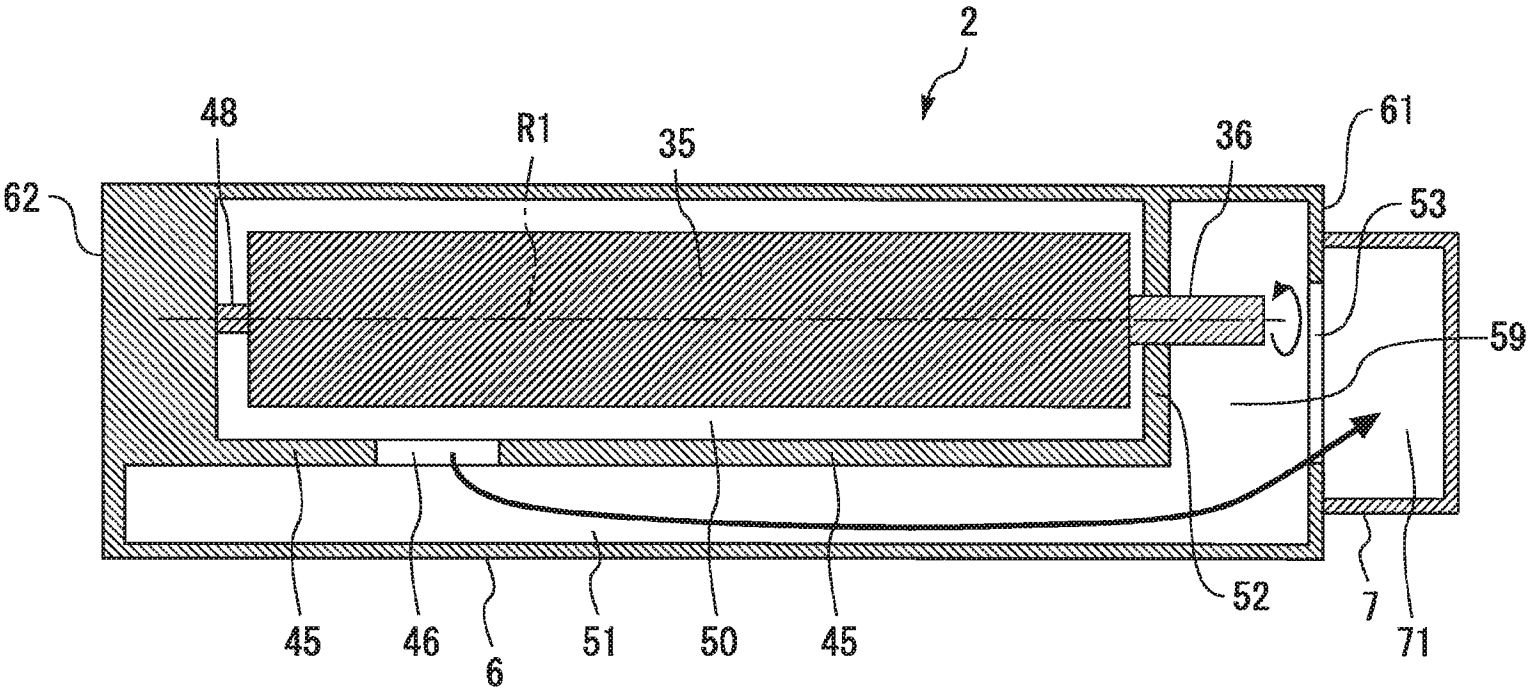
FIG. 16 is a cross-sectional view taken along line F-F in FIG. 15.

FIG. 14 is a bottom view of the cleaner head 2 according to the first embodiment. FIG. 15 is a cross-sectional view taken along line E-E in FIG. 14. FIG. 16 is a cross-sectional view taken along line F-F in FIG. 15. FIGS. 14 to 16 show shapes and structures of the respective parts being partially simplified or omitted as compared to reality for the sake of convenience.

As shown in FIGS. 14 and 15, the cleaner head 2 includes an agitator 35 and a motor 37. The agitator 35 is rotatably mounted in the body 6. An axis of rotation R1 of the agitator 35 is substantially parallel to the longitudinal direction of the body 6. As the agitator 35 rotates, a surface to be cleaned is agitated and dust is stirred up from the surface to be cleaned. When the body 6 includes the upper case 31 and the lower case 32, the agitator 35 may be mounted in the lower case 32. A driven wheel 36 is coupled to one end of the agitator 35. The driven wheel 36 is rotated integrally with the agitator 35. Another end of the agitator 35 is rotatably supported with respect to the body 6 via a shaft 48.

The motor 37 causes the agitator 35 to rotate. The motor 37 according to the present embodiment is an electric motor. In the present invention, the motor that causes the agitator 35 to rotate is not limited to an electric motor and may instead be, for example, a turbine which is rotated by an air flow. The motor 37 includes a driving shaft 38. An axis of rotation R2 of the driving shaft 38 of the motor 37 is substantially parallel to the axis of rotation R1 of the agitator 35. The driving shaft 38 is connected to the driven wheel 36 via a driving belt 40. The agitator 35 rotates as a driving force of the motor 37 is transmitted to the agitator 35 via the driving shaft 38, the driving belt 40, and the driven wheel 36. Moreover, FIG. 15 represents a cross-section taken along line E-E in FIG. 14 with respect to the body 6 and represents a side view as seen from a side of the proximal end 61 of the body 6 with respect to the agitator 35, the driven wheel 36, the motor 37, the driving shaft 38, and the driving belt 40. As an alternative to the illustrated configuration, the driving force of the motor 37 may be transmitted to the agitator 35 by other means of transmission such as a gear train.

The body 6 includes a suction opening 49 and an agitator chamber 50. The agitator chamber 50 is formed inside the body 6. The suction opening 49 opens on a bottom surface of the body 6. The agitator chamber 50 houses the agitator 35. The suction opening 49 is formed as at least a part of a bottom surface of the agitator chamber 50 opens. When an electric air blower 24 operates, dirty air is sucked in from the suction opening 49. The body 6 may further include a suction opening formed on a surface (for example, a side surface) other than the bottom surface of the body 6. In this case, a total opening area of the suction opening formed on a surface other than the bottom surface of the body 6 is desirably smaller than a total opening area of the suction opening 49 formed on the bottom surface of the body 6. Adopting such a configuration produces the following effects. Since dust can be mainly sucked in from the suction opening 49 formed on the bottom surface of the body 6, a variation in suction performance can be reduced.

With the present embodiment, the following effects are produced due to making the axis of rotation R2 of the motor 37 substantially parallel to the axis of rotation R1 of the agitator 35. The motor 37 can be arranged in a space-saving manner. The area of the suction opening 49 can be increased. A weight of the cleaner head 2 can be reduced. As shown in FIG. 14, in the present embodiment, a direction in which the driving shaft 38 protrudes from the motor 37 is the same as a direction in which the driven wheel 36 protrudes from the agitator 35.

As shown in FIG. 15, the agitator 35 includes a cylindrical substrate 43 and a protruding member 44. The protruding member 44 protrudes from an outer circumferential surface of the cylindrical substrate 43. The protruding member 44 is held by a holding portion (not shown) included in the cylindrical substrate 43. As the protruding member 44, for example, any of a fibrous brush bristle, a blade-like member made of a soft material, and a combination thereof may be used. The protruding member 44 may be arranged on an outer circumference of the cylindrical substrate 43 in a helical shape around the axis of rotation R1. In doing so, the protruding member 44 may be arranged in at least two or more rows (for example, four rows) and a helical valley portion may be formed between the rows. Alternatively, the protruding member 44 may be arranged parallel to the axis of rotation R1 on the outer circumference of the cylindrical substrate 43.

As shown in FIG. 14, in the present embodiment, the motor 37 is arranged at a position closer to the proximal end 61 than to the distal end 62 of the body 6. As shown in FIG. 15, a distance between the axis of rotation R2 of the motor 37 and the bottom surface of the body 6 is greater than a distance between the axis of rotation R1 of the agitator 35 and the bottom surface of the body 6. With the present embodiment, due to the configuration described above, the following effects are produced. Since the position of the motor 37 which is a relatively heavy component approaches the joint 7, a center of gravity can be brought closer to the joint 7. As a result, the user can move the cleaner head 2 with less force.

As shown in FIG. 16, the joint 7 includes a first suction channel 71. The first suction channel 71 is communicated with the inside of the suction pipe 8. The first suction channel 71 functions as a channel (an air channel) for dirty air. The first suction channel 71 is formed inside the joint 7. The body 6 includes a second suction channel 51 and a bulkhead 45. The second suction channel 51 and the bulkhead 45 are formed inside the body 6. The second suction channel 51 extends substantially parallel to the axis of rotation R1 of the agitator 35. The second suction channel 51 is communicated with the first suction channel 71 inside the joint 7. The second suction channel 51 functions as a channel (an air channel) for dirty air. The bulkhead 45 separates the agitator chamber 50 and the second suction channel 51 from each other. The bulkhead 45 includes an air vent 46 from the agitator chamber 50 to the second suction channel 51. While the bulkhead 45 according to the present embodiment includes only one air vent 46, alternatively, the bulkhead 45 may include a plurality of air vents 46. The air vent 46 faces an outer circumference of the agitator 35. The bulkhead 45 is substantially parallel to the axis of rotation R1 of the agitator 35.

The body 6 according to the present embodiment includes a third suction channel 59, a bulkhead 52, and an opening 53. The third suction channel 59 and the bulkhead 52 are formed inside the body 6. The opening 53 opens on a connection surface between the body 6 and the joint 7. The third suction channel 59 extends substantially perpendicular to the axis of rotation R1 of the agitator 35. The third suction channel 59 is formed at a position that is closer to the proximal end 61 than to the distal end 62 of the body 6. The bulkhead 52 separates the agitator chamber 50 and the third suction channel 59 from each other. The bulkhead 45 is connected to the bulkhead 52. The bulkhead 52 is substantially perpendicular to the axis of rotation R1 of the agitator 35. In the present embodiment, the second suction channel 51 is communicated with the first suction channel 71 inside the joint 7 via the third suction channel 59 and the opening 53. In this manner, the second suction channel 51 may be communicated with the first suction channel 71 via another channel. In addition to such a configuration, the second suction channel 51 may be directly communicated with the first suction channel 71 without involving another channel.

In the present embodiment, the second suction channel 51 and the bulkhead 45 are formed along the axis of rotation R1 of the agitator 35 approximately over an entire length of the agitator 35. In addition to such a configuration, the second suction channel 51 and the bulkhead 45 may be formed along the axis of rotation R1 of the agitator 35 in a part of the entire length of the agitator 35.

An arrow shown in FIG. 16 indicates a flow of dirty air. Dirty air having flowed into the body 6 from the suction opening 49 passes through the agitator chamber 50, the air vent 46, the second suction channel 51, the third suction channel 59, and the opening 53 and proceeds to the first suction channel 71 in the joint 7. According to the present embodiment, the following effects are produced due to providing the bulkhead 45 separating the agitator chamber 50 and the second suction channel 51 from each other with the air vent 46. An amount of suction from the suction opening 49 can be prevented from becoming biased toward the side of the joint 7 and a variation in the amount of suction can be reduced in an entire region of the suction opening 49. Dust stirred up by the agitator 35 can be efficiently sucked into the second suction channel 51 from the air vent 46.

In the present embodiment, the air vent 46 is at a position that is biased toward a side of the distal end 62 with respect to a center of the length of the agitator 35 in the longitudinal direction of the body 6. As a result, the following effect is produced. A variation in the amount of suction can be more reliably reduced in the entire region of the suction opening 49. A variation in the amount of suction in the longitudinal direction of the agitator 35 can be reduced. When the bulkhead 45 includes a plurality of air vents 46, an effect similar to that described above is produced by positioning at least one of the plurality of air vents 46 as described above. When the bulkhead 45 includes one air vent 46, an effect similar to that described above is produced when the air vent 46 is at a central position of the length of the agitator 35 in the longitudinal direction of the body 6. When the bulkhead 45 includes a plurality of air vents 46, an effect similar to that described above is produced when at least one of the air vents 46 is at a central position of the length of the agitator 35 in the longitudinal direction of the body 6.

As shown in FIG. 15, the body 6 according to the present embodiment includes a bulkhead 34 and a motor chamber 39. The motor chamber 39 houses the motor 37. The bulkhead 34 separates the motor chamber 39 and the agitator chamber 50 from each other and separates the motor chamber 39 and the second suction channel 51 from each other. The motor 37 is at least partially positioned above the second suction channel 51. The bulkhead 45 may be at least partially perpendicular to the bottom surface of the body 6 and the surface to be cleaned. The present embodiment adopts the following configuration. The second suction channel 51 is at least partially positioned between the bottom surface of the body 6 and the motor 37. A position of an inner wall surface in an upper part of the second suction channel 51 is lower than an upper end of the agitator 35. According to such a configuration, with the present embodiment, a width W of the body 6 and a height of the body 6 can be reduced.

With the present embodiment, the following effects are produced. The joint 7 is rotatable with respect to the body 6 around the first pivot axis X and the second pivot axis Y in a state where an opening direction of the suction opening 49 formed on the body 6 is maintained. Due to the joint 7 being rotatable around the first pivot axis X and the second pivot axis Y, the body 6 can maintain the opening direction of the suction opening 49 regardless of a movement in the twisting direction A and a movement in an inclination direction B. Accordingly, an angle of the suction opening 49 does not change with respect to the surface to be cleaned and a distance between the suction opening 49 and the surface to be cleaned remains the same. Thus, a degree of vacuum around the suction opening 49 can be prevented from declining, and the body 6 can be operated while maintaining suction performance.

The length L of the body 6 is favorably equal to or greater than 10 cm. When the length L of the body 6 is equal to or greater than 10 cm, a cleaning range when the cleaner head 2 is used in the L-shape-mode and when the body 6 is rotated by a movement in the twisting direction A can be sufficiently widened. The length L of the body 6 is favorably equal to or less than 30 cm. When the length L of the body 6 is equal to or less than 30 cm, a suction force capable of sufficiently sucking in dust can be secured even at an end of the suction opening 49 which is positioned far from the joint 7.

With the present embodiment, since the joint 7 is connected to an end surface of the proximal end 61 of the body 6, the following effects are produced. Since a radius of rotation when rotating the body 6 around the joint 7 in a plan view can be further increased, cleaning can be performed even more efficiently. Since a height of the joint 7 from the surface to be cleaned is reduced and low places such as underneath a sofa can be cleaned with greater ease, operability of the cleaner head 2 can be improved.

As shown in FIGS. 9 and 11, in a state where the angle of rotation of the first pivot axis X is 0°, sizes of the joint 7 and the suction pipe 8 along the width direction of the body 6 are smaller than the maximum width W of the body 6. According to such a configuration, with the present embodiment, the following effects are produced. When a width of a narrow space is equal to or greater than the maximum width W of the body 6, the cleaner head 2 can be inserted into the narrow space in the I-shape-mode and the narrow space can be cleaned.

As shown in FIG. 11, the joint 7 is positioned substantially at center in the width direction of the body 6. In other words, in a plan view, a connection portion of the joint 7 and an end surface of the proximal end 61 is positioned substantially at center of the width W of the body 6. According to such a configuration, with the present embodiment, the following effects are produced. When the cleaner head 2 is inserted into a narrow space in the I-shape-mode, the joint 7 and the suction pipe 8 can be more reliably prevented from obstructing the cleaner head 2. Since the body 6 is less likely to separate from the surface to be cleaned when the cleaner head 2 is moved, high suction performance can be maintained and operability can be improved.

As shown in FIG. 14, the body 6 according to the present embodiment includes an agitator introduction/removal port 54 which connects to an end surface of the distal end 62 from the agitator chamber 50. By withdrawing the agitator 35 from the body 6 through the agitator introduction/removal port 54, the agitator 35 can be removed from the body 6. By detaching the agitator 35 from the body 6, dirt adhered to the agitator 35 can be readily removed. Since the outer circumference of the agitator 35 is elastically deformable, the agitator 35 is capable of passing through the agitator introduction/removal port 54 of which an inner diameter is smaller than an outer diameter of the agitator 35. The shaft 48 supporting the agitator 35 is coupled to a plug 55. The agitator 35 is rotatable with respect to the plug 55. In a state where the agitator 35 is appropriately mounted in the body 6, the plug 55 closes the agitator introduction/removal port 54. The cleaner head 2 desirably includes a locking mechanism (not shown) capable of switching between a state where the plug 55 is locked with respect to the agitator introduction/removal port 54 and a state where the lock is released. Since the locking mechanism is well known, a description thereof will be omitted. With the present embodiment, due to the motor 37 being arranged at a position closer to the proximal end 61 than to the distal end 62 of the body 6, a structure enabling the agitator 35 to be withdrawn from the agitator introduction/removal port 54 can be readily achieved.

As shown in FIG. 14, the cleaner head 2 according to the present embodiment includes a roller 47 installed in a lower part of the body 6. The roller 47 is rotatable while being in contact with the surface to be cleaned. The roller 47 is capable of supporting the body 6 on the surface to be cleaned. Providing the roller 47 enables the body 6 to move more smoothly on the surface to be cleaned. The user can move the body 6 of the cleaner head 2 with respect to the surface to be cleaned with an even smaller force. An orientation of the roller 47 may be made variable in order to enable the roller 47 to accommodate both a movement of the body 6 in the width direction (the L-shape-mode described earlier) with respect to the surface to be cleaned and a movement of the body 6 in the longitudinal direction (the I-shape-mode described earlier) with respect to the surface to be cleaned. Alternatively, a spherical roller rotatable in any direction may be installed in the lower part of the body 6.

The cleaner head 2 may include a movable wheel (not shown) such as that described below. The movable wheel is supported with respect to the body 6 so as to be displaceable to a first position where the movable wheel protrudes from the bottom surface of the body 6 and a second position where the movable wheel is retracted inside the body 6. The movable wheel is biased in a direction from the second position toward the first position. The movable wheel is at the second position when the body 6 is on the surface to be cleaned. The movable wheel moves from the second position to the first position when the body 6 is separated from the surface to be cleaned. The body 6 includes a switch (not shown) which is turned on when the movable wheel is at the second position and turned off when the movable wheel is at the first position. When the switch is in the on-state during an operation of the electric air blower 24, power is supplied to the motor 37 and the agitator 35 rotates. When the switch is in the off-state, the supply of power to the motor 37 is suspended and the agitator 35 stops. By adopting the configuration described above, the agitator 35 can be prevented from rotating in a state where the body 6 is separated from the surface to be cleaned. Thus, a hand and the like can be reliably prevented from coming into contact with the rotating agitator 35.

The movable wheel described above may be at least partially constructed by a fibrous material or a soft material such as an elastomer. For example, the movable wheel may be at least partially formed of a material that is softer than a material of a main part of the body 6. A buffer (not shown) formed of a relatively deformable soft material (for example, an elastomer or vinyl chloride) may be installed in a lower part on a front side (an upper side in FIG. 14) of the body 6.

Second Embodiment

Figure 17:
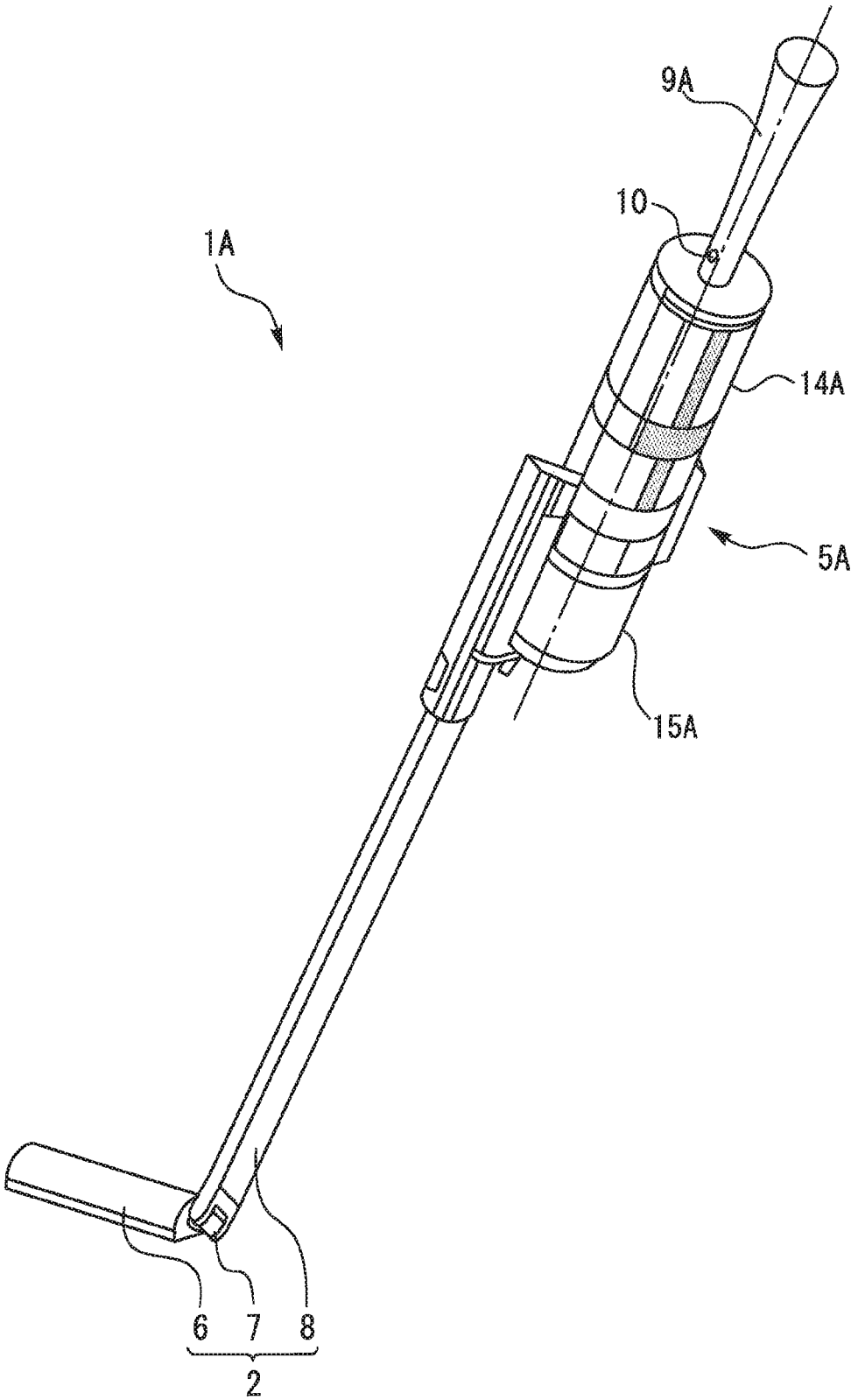
FIG. 17 is a perspective view of a vacuum cleaner according to a second embodiment.

Next, while a second embodiment will be described with reference to FIG. 17, the description will focus on differences from the first embodiment described above and descriptions of same or equivalent portions will be simplified or omitted. FIG. 17 is a perspective view of a vacuum cleaner 1A according to the second embodiment. The vacuum cleaner 1A shown in FIG. 17 is, for example, a cordless rechargeable vacuum cleaner. The vacuum cleaner 1A according to the present second embodiment includes the cleaner head 2, a cleaner main body 5A, and a handle 9A. The cleaner head 2 included in the vacuum cleaner 1A according to the present second embodiment shares a same structure as the cleaner head 2 according to the first embodiment. An external shape of the cleaner main body 5A is a roughly columnar shape. The cleaner main body 5A includes a housing unit 14A and a dust collecting unit 15A. External shapes of the housing unit 14A and the dust collecting unit 15A are roughly columnar shapes. The dust collecting unit 15A is attachably and detachably mounted to a lower side of the housing unit 14A. The rod-like handle 9A is coupled to an upper part of the cleaner main body 5A. A central axis of the handle 9A may coincide with a central axis of the cleaner main body 5A. The central axis of the handle 9A may coincide with central axes of the housing unit 14A and the dust collecting unit 15A. In FIG. 17, the central axis of the handle 9A and the central axis of the cleaner main body 5A are indicated by a long dashed short dashed line.

In the present second embodiment, the cleaner head 2 is connected to the cleaner main body 5A without involving the suction hose 4. The suction pipe 8 is communicated with an inside of the dust collecting unit 15A. A central axis of the suction pipe 8 may be parallel to the central axis of the cleaner main body 5A. When using the vacuum cleaner 1A, the user grips the handle 9A to carry out cleaning while supporting a weight of the cleaner main body 5A. The vacuum cleaner 1A according to the present second embodiment includes an electric air blower (not shown) housed inside the housing unit 14A. A central axis of the electric air blower may coincide with the central axis of the housing unit 14A. A central axis of the handle 9A may coincide with the central axis of the electric air blower. According to the second embodiment described above, similar effects to the first embodiment are produced.

Third Embodiment

Figure 18:
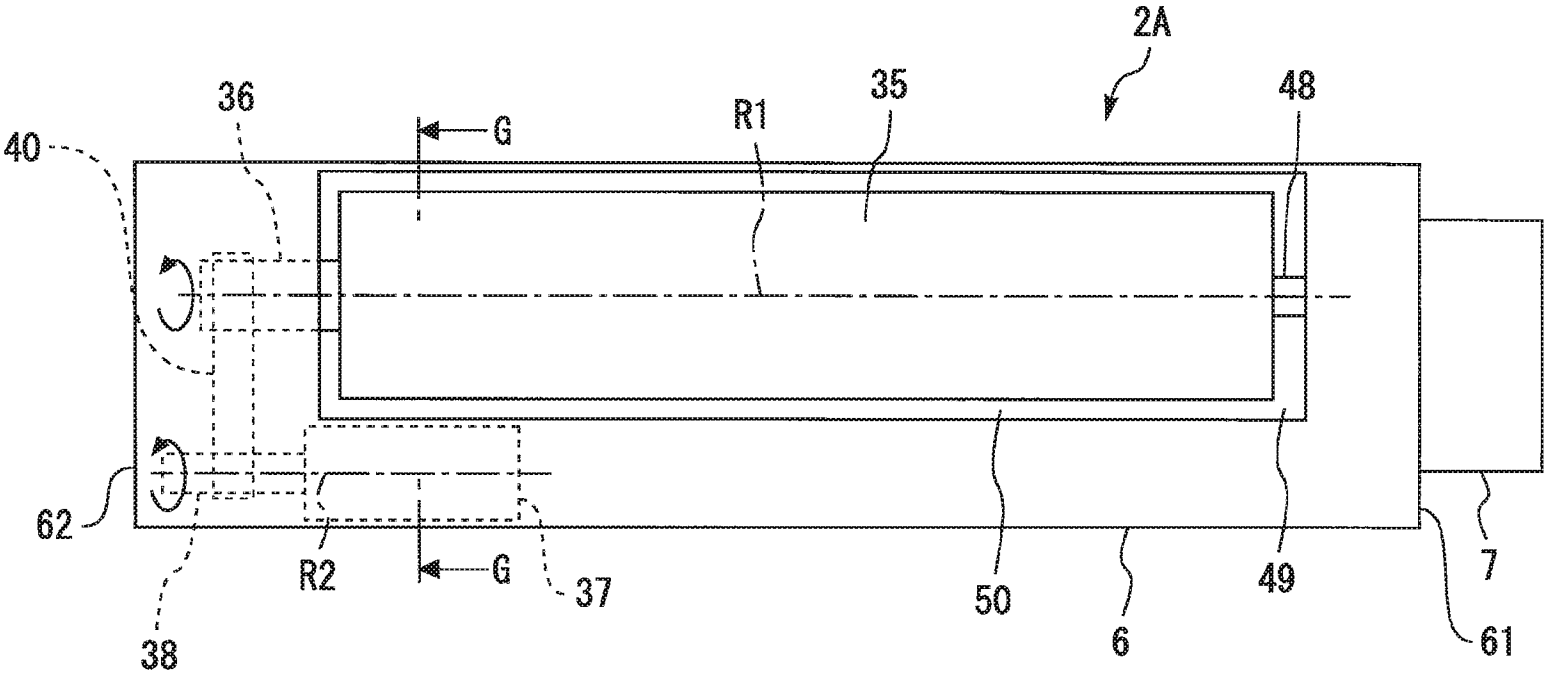
FIG. 18 is a bottom view of a cleaner head according to a third embodiment.
Figure 19:
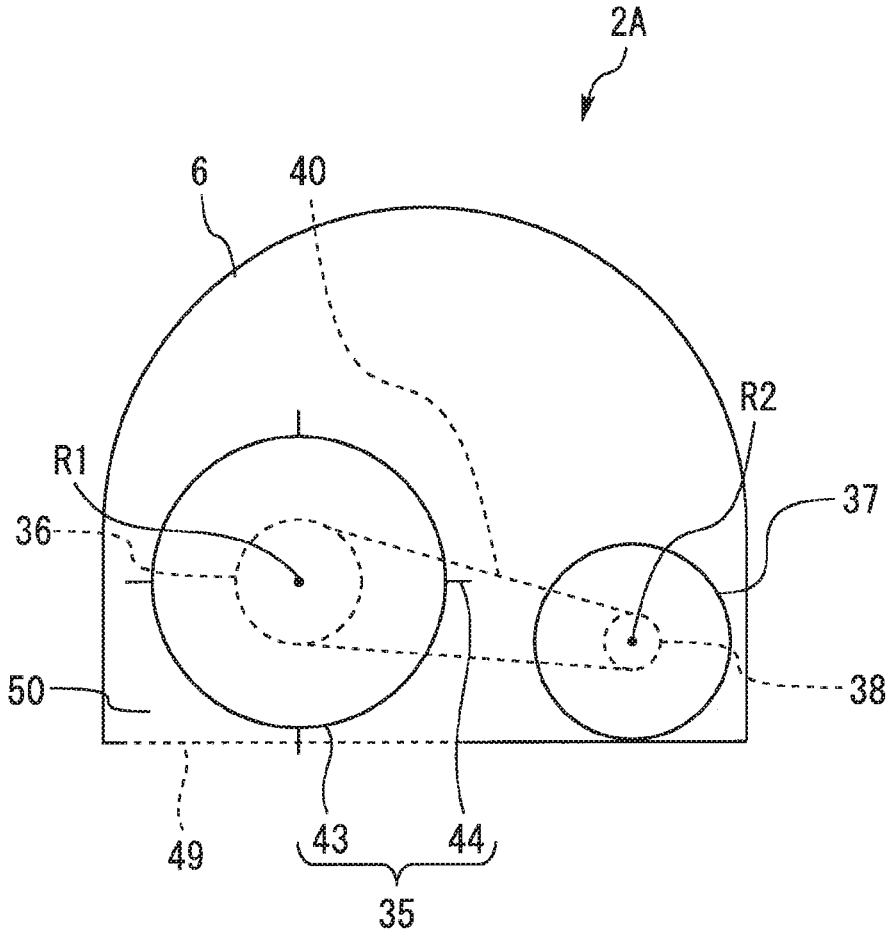
FIG. 19 is a schematic cross-sectional view taken along line G-G in FIG. 18.

Next, while a third embodiment will be described with reference to FIGS. 18 and 19, the description will focus on differences from the first embodiment described above and descriptions of same or equivalent portions will be simplified or omitted. FIG. 18 is a bottom view of a cleaner head 2A according to the third embodiment. FIG. 19 is a schematic cross-sectional view taken along line G-G in FIG. 18. Moreover, in FIG. 18 and subsequent drawings including embodiments to be described later, shapes, structures, wall thicknesses, and the like of the respective parts will be shown partially omitted or simplified for the sake of convenience.

As shown in FIG. 18, in the cleaner head 2A according to the present third embodiment, the motor 37 is arranged at a position closer to the distal end 62 than to the proximal end 61 of the body 6. According to such a configuration, with the present embodiment, the following effects are produced. Since an influence of an arrangement of the motor 37 on a shape of a suction channel (not shown in the present embodiment) near the joint 7 can be prevented, the shape of the suction channel near the joint 7 can be readily and favorably formed. Since the motor 37 can be arranged at a distant position from a flow of dirty air toward the joint 7, less dust enters the motor 37. The motor 37 can be cooled more readily. Service life of the motor 37 can be extended. Since a rotational speed of the agitator 35 can be improved, dust removing performance is improved.

As shown in FIG. 19, in the cleaner head 2A according to the present third embodiment, a distance between the axis of rotation R2 of the motor 37 and the bottom surface of the body 6 is smaller than a distance between the axis of rotation R1 of the agitator 35 and the bottom surface of the body 6. According to such a configuration, with the present embodiment, the following effects are produced. By mounting the motor 37 which is a relatively heavy component at a low position, the center of gravity can be lowered. As a result, a posture of the body 6 with respect to the surface to be cleaned can be further stabilized. A total height of the body 6 can be formed lower. Moreover, FIG. 19 uses the following notation for the sake of convenience. The suction opening 49 is depicted by a dashed line. Illustration of a bulkhead between the agitator chamber 50 and the motor 37 is omitted.

Fourth Embodiment

Figure 20:
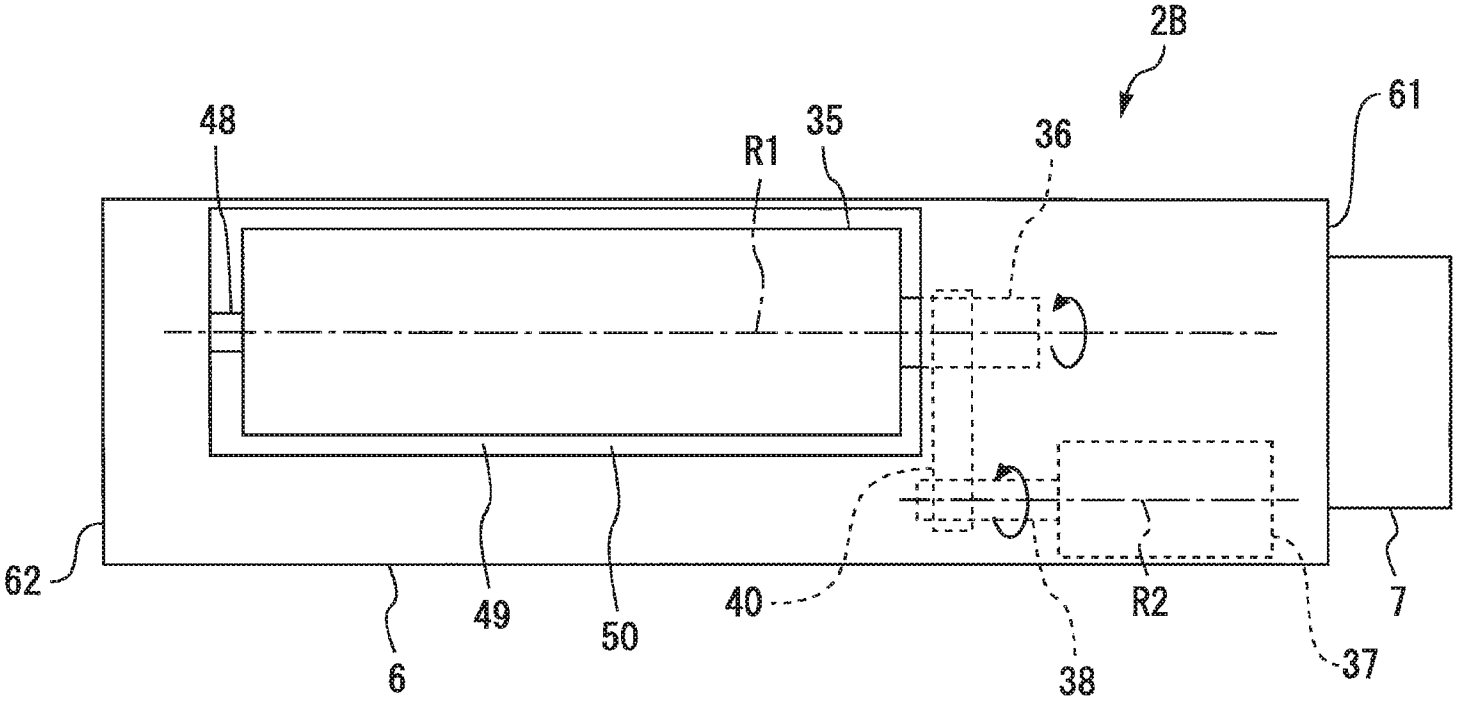
FIG. 20 is a bottom view of a cleaner head according to a fourth embodiment.

Next, while a fourth embodiment will be described with reference to FIG. 20, the description will focus on differences from the first embodiment described above and descriptions of same or equivalent portions will be simplified or omitted. FIG. 20 is a bottom view of a cleaner head 2B according to the fourth embodiment.

As shown in FIG. 20, in the cleaner head 2B according to the present fourth embodiment, the direction in which the driving shaft 38 protrudes from the motor 37 is opposite to the direction in which the driven wheel 36 protrudes from the agitator 35. According to such a configuration, with the present embodiment, the following effects are produced. An arrangement space of the motor 37 can be readily prevented from interfering with an arrangement space of the agitator 35. The width W of the body 6 and the height of the body 6 can be reduced.

Fifth Embodiment

Figure 21:
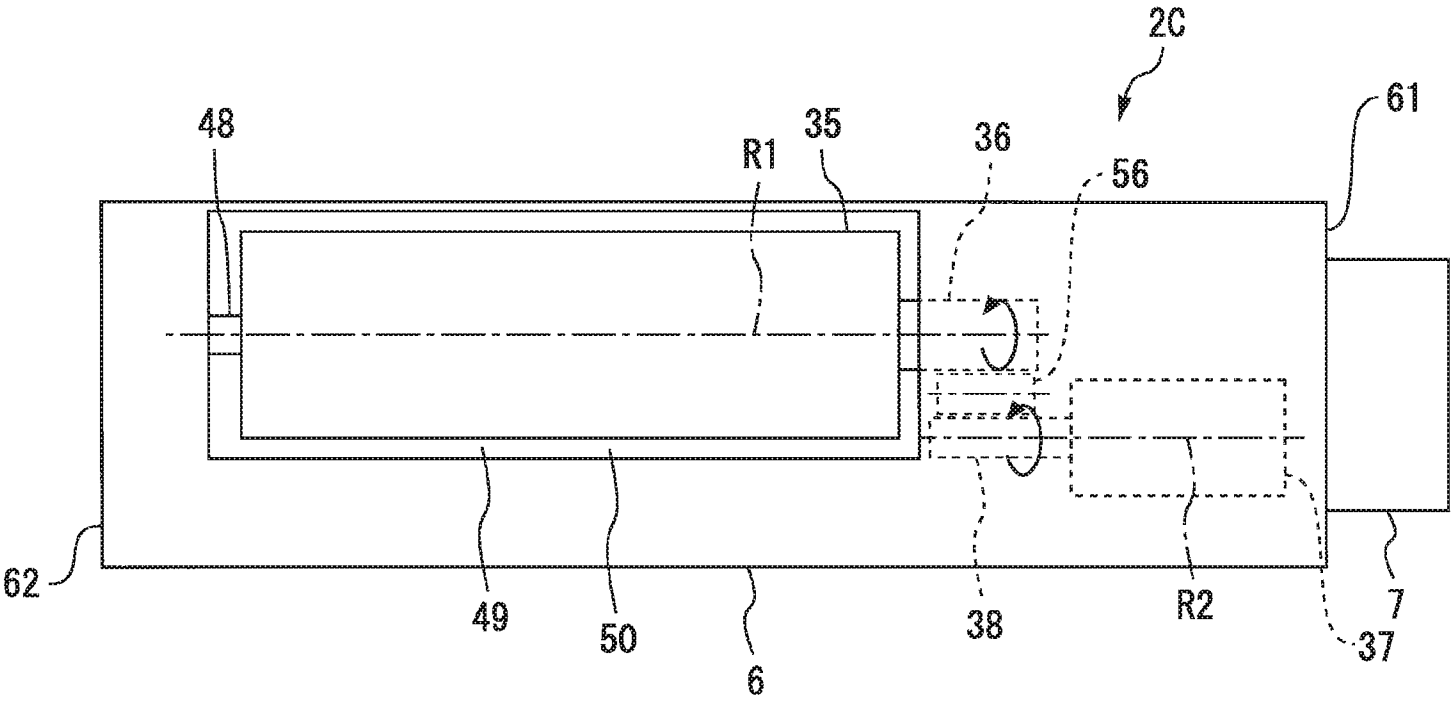
FIG. 21 is a bottom view of a cleaner head according to a fifth embodiment.

Next, while a fifth embodiment will be described with reference to FIG. 21, the description will focus on differences from the first embodiment described above and descriptions of same or equivalent portions will be simplified or omitted. FIG. 21 is a bottom view of a cleaner head 2C according to the fifth embodiment.

As shown in FIG. 21, the cleaner head 2C according to the present fifth embodiment is configured as follows. The direction in which the driving shaft 38 protrudes from the motor 37 is opposite to the direction in which the driven wheel 36 protrudes from the agitator 35. The cleaner head 2C includes an intermediate gear 56 in place of the driving belt 40 according to the first embodiment. A gear is formed on an outer circumference of the driven wheel 36. The gear of the driven wheel 36 meshes with the intermediate gear 56. A gear is formed on an outer circumference of the driving shaft 38. The gear of the driving shaft 38 meshes with the intermediate gear 56. The agitator 35 rotates as a driving force of the motor 37 is transmitted to the agitator 35 via the driving shaft 38, the intermediate gear 56, and the driven wheel 36. According to the configuration described above, with the present embodiment, the following effects are produced. An arrangement space of the motor 37 can be readily prevented from interfering with an arrangement space of the agitator 35. The width W of the body 6 and the height of the body 6 can be reduced.

Sixth Embodiment

Figure 22:
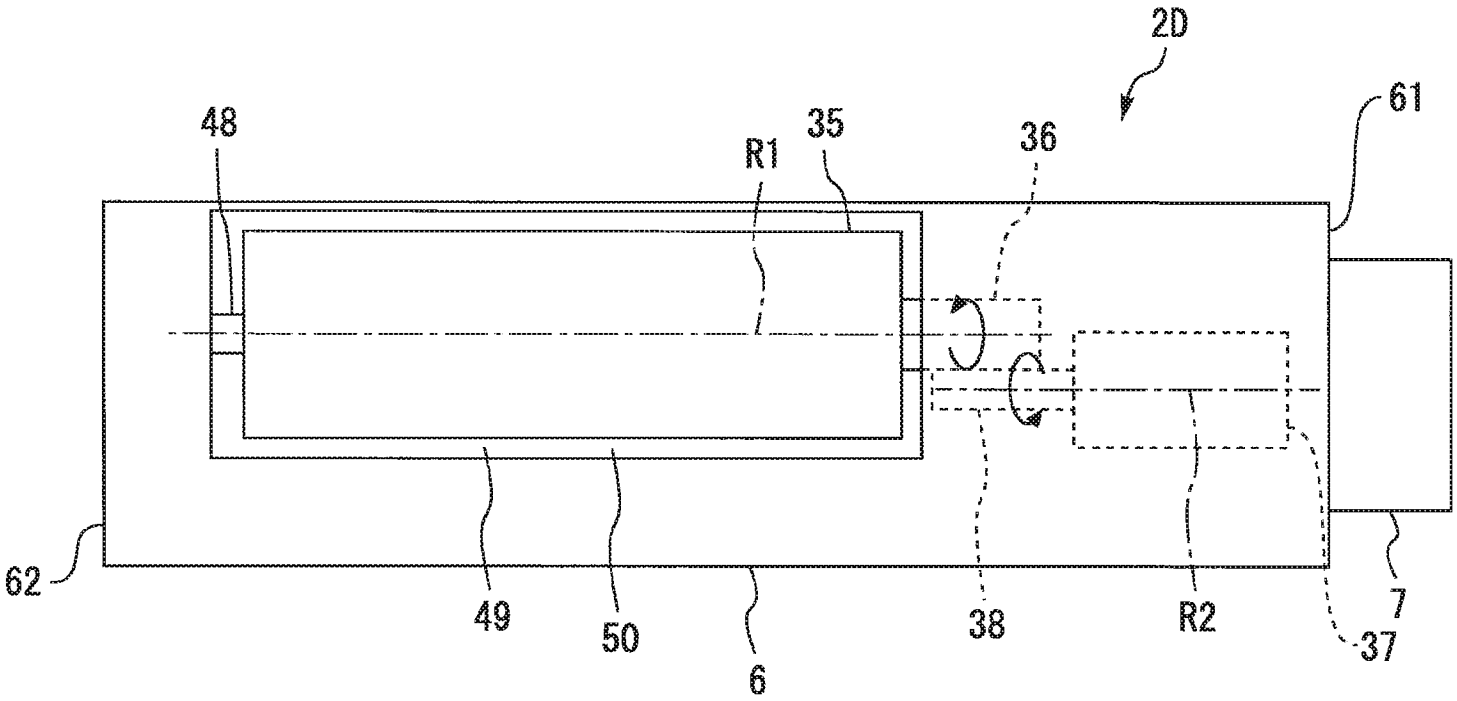
FIG. 22 is a bottom view of a cleaner head according to a sixth embodiment.

Next, while a sixth embodiment will be described with reference to FIG. 22, the description will focus on differences from the first embodiment described above and descriptions of same or equivalent portions will be simplified or omitted. FIG. 22 is a bottom view of a cleaner head 2D according to the sixth embodiment.

As shown in FIG. 22, the cleaner head 2D according to the present sixth embodiment is configured as follows. The direction in which the driving shaft 38 protrudes from the motor 37 is opposite to the direction in which the driven wheel 36 protrudes from the agitator 35. A gear is formed on an outer circumference of the driven wheel 36. A gear is formed on an outer circumference of the driving shaft 38. The gear of the driven wheel 36 directly meshes with the gear of the driving shaft 38. As the driving shaft 38 of the motor 37 rotates, the driven wheel 36 rotates and, in turn, the agitator 35 rotates. According to the configuration described above, with the present embodiment, the following effects are produced. An arrangement space of the motor 37 can be readily prevented from interfering with an arrangement space of the agitator 35. The width W of the body 6 and the height of the body 6 can be reduced.

Seventh Embodiment

Figure 23:
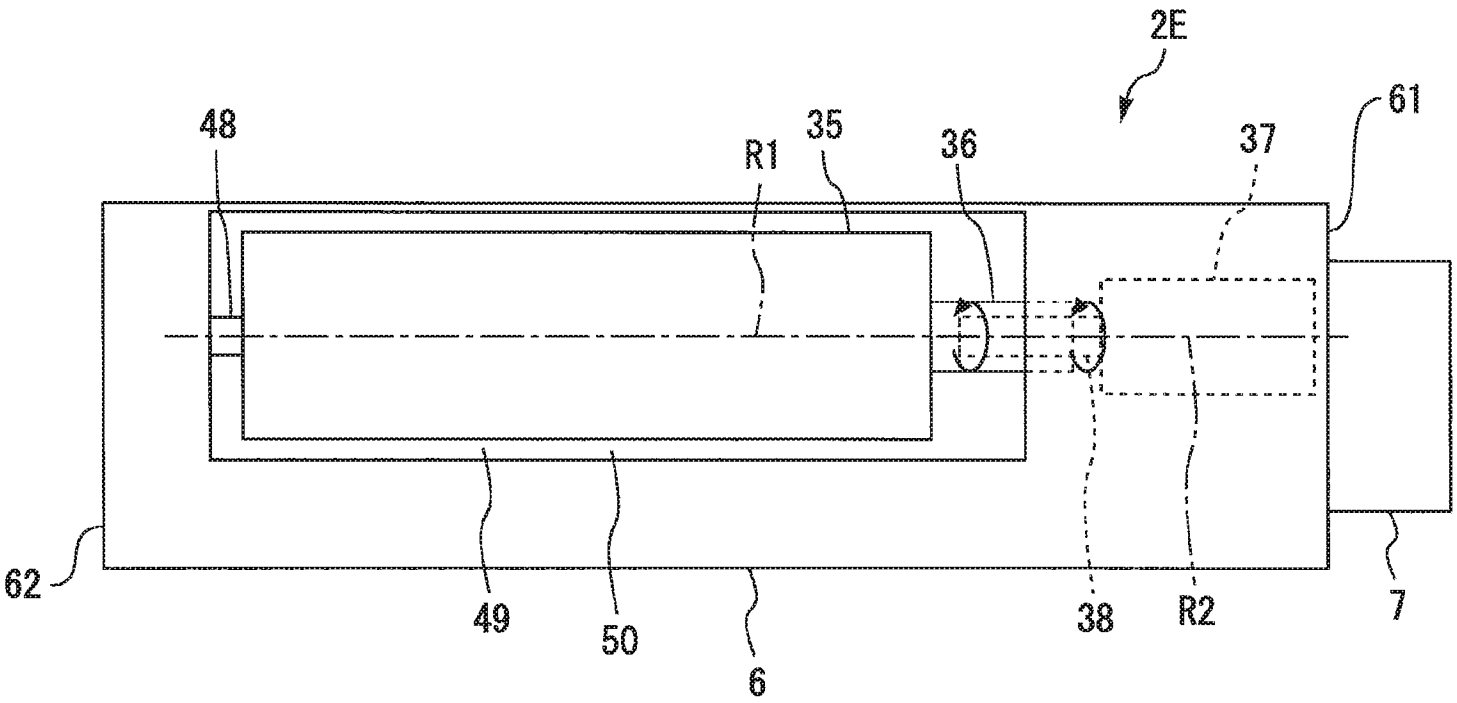
FIG. 23 is a bottom view of a cleaner head according to a seventh embodiment.

Next, while a seventh embodiment will be described with reference to FIG. 23, the description will focus on differences from the first embodiment described above and descriptions of same or equivalent portions will be simplified or omitted. FIG. 23 is a bottom view of a cleaner head 2E according to the seventh embodiment.

As shown in FIG. 23, the cleaner head 2E according to the present seventh embodiment is configured as follows. The direction in which the driving shaft 38 protrudes from the motor 37 is opposite to the direction in which the driven wheel 36 protrudes from the agitator 35. The axis of rotation R2 of the driving shaft 38 of the motor 37 is coaxial with the axis of rotation R1 of the agitator 35 and the driven wheel 36. The driving shaft 38 is coupled to the driven wheel 36. The driving shaft 38, the driven wheel 36, and the agitator 35 rotate integrally. According to the configuration described above, with the present embodiment, the following effects are produced. An arrangement space of the motor 37 can be readily prevented from interfering with an arrangement space of the agitator 35. The width W of the body 6 and the height of the body 6 can be reduced.

A diameter (an outer diameter) of the motor 37 is equal to or smaller than a diameter (an outer diameter) of the agitator 35. In the present seventh embodiment, when viewed from a direction parallel to the axis of rotation R1 of the agitator 35, the outer circumference of the motor 37 is inside the outer circumference of the agitator 35. According to such a configuration, with the present embodiment, the following effects are produced. The motor 37 can be arranged in a space-saving manner. The width W of the body 6 and the height of the body 6 can be further reduced. Moreover, even in a configuration in which the axis of rotation R2 of the driving shaft 38 of the motor 37 is substantially parallel to the axis of rotation R1 of the agitator 35 as in the sixth embodiment (FIG. 22) described earlier, the outer circumference of the motor 37 can be arranged inside the outer circumference of the agitator 35 when viewed from a direction parallel to the axis of rotation R1 of the agitator 35. In this case, effects similar to those described earlier are produced.

Eighth Embodiment

Figure 24:
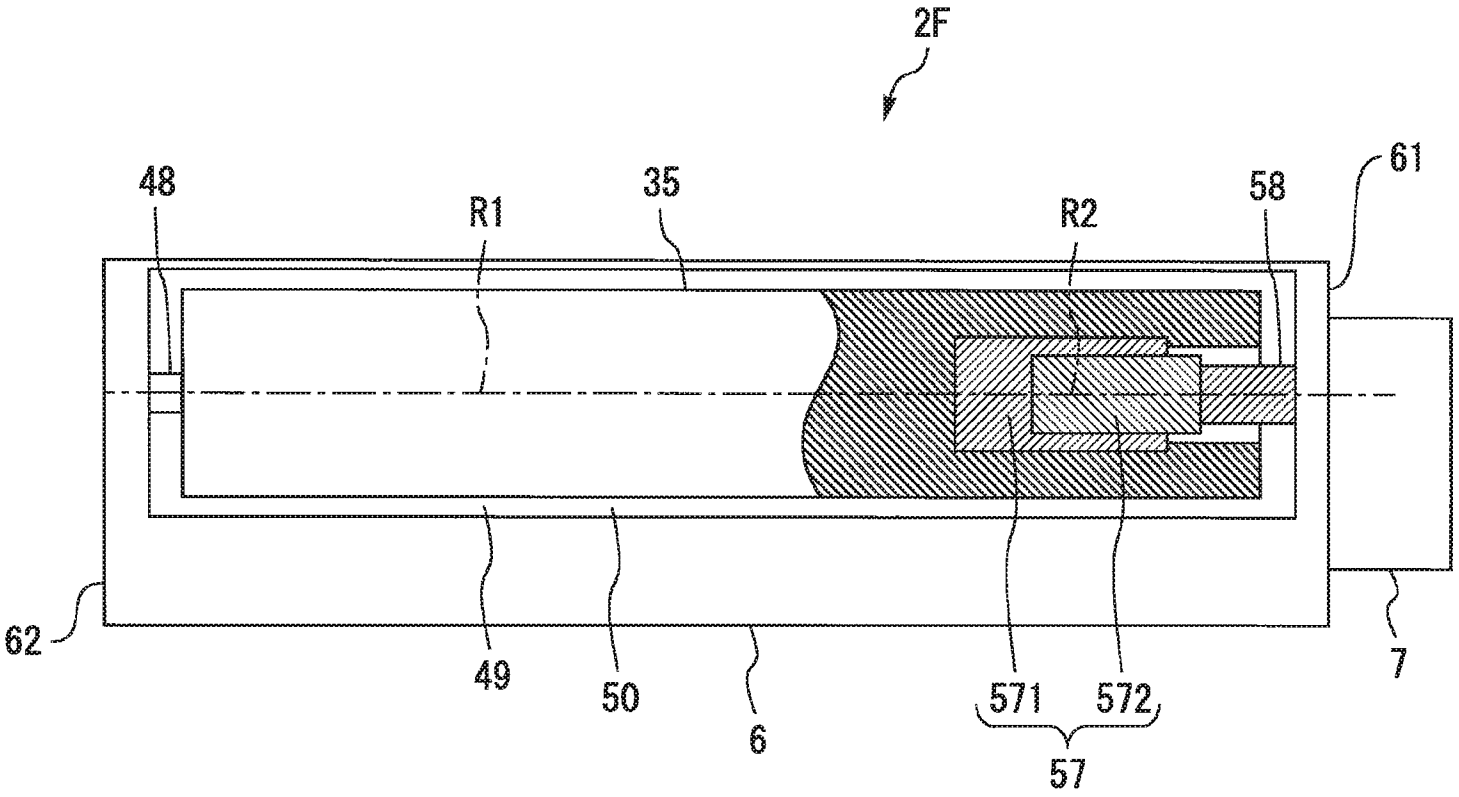
FIG. 24 is a bottom view of a cleaner head according to an eighth embodiment.

Next, while an eighth embodiment will be described with reference to FIG. 24, the description will focus on differences from the first embodiment described above and descriptions of same or equivalent portions will be simplified or omitted. FIG. 24 is a bottom view of a cleaner head 2F according to the eighth embodiment.

As shown in FIG. 24, the cleaner head 2F according to the present eighth embodiment is configured as follows. The cleaner head 2F includes an outer rotor-type motor 57 and a fixed shaft 58 in place of the driven wheel 36, the motor 37, and the driving belt 40 according to the first embodiment. The motor 57 includes an outer rotor 571 and an inner stator 572. The motor 57 is arranged inside the agitator 35. An axis of rotation R2 of the outer rotor 571 of the motor 57 is coaxial with the axis of rotation R1 of the agitator 35. The outer rotor 571 is fixed to the agitator 35. The inner stator 572 is fixed to the body 6 via the fixed shaft 58. The inner stator 572 is non-rotatable with respect to the body 6. When power is supplied to the motor 57, the agitator 35 and the outer rotor 571 rotate integrally. FIG. 24 shows a longitudinal sectional view of a part of the agitator 35, the motor 57, and the fixed shaft 58.

According to the configuration described above, with the present eighth embodiment, the following effects are produced. By arranging the motor 57 that causes the agitator 35 to rotate inside the agitator 35, space-saving can be achieved. The body 6 can be downsized. Since an influence of an arrangement of the motor 57 on a shape of a suction channel (not shown in the present embodiment) near the joint 7 can be prevented, the shape of the suction channel near the joint 7 can be readily and favorably formed.

Ninth Embodiment

Figure 25:
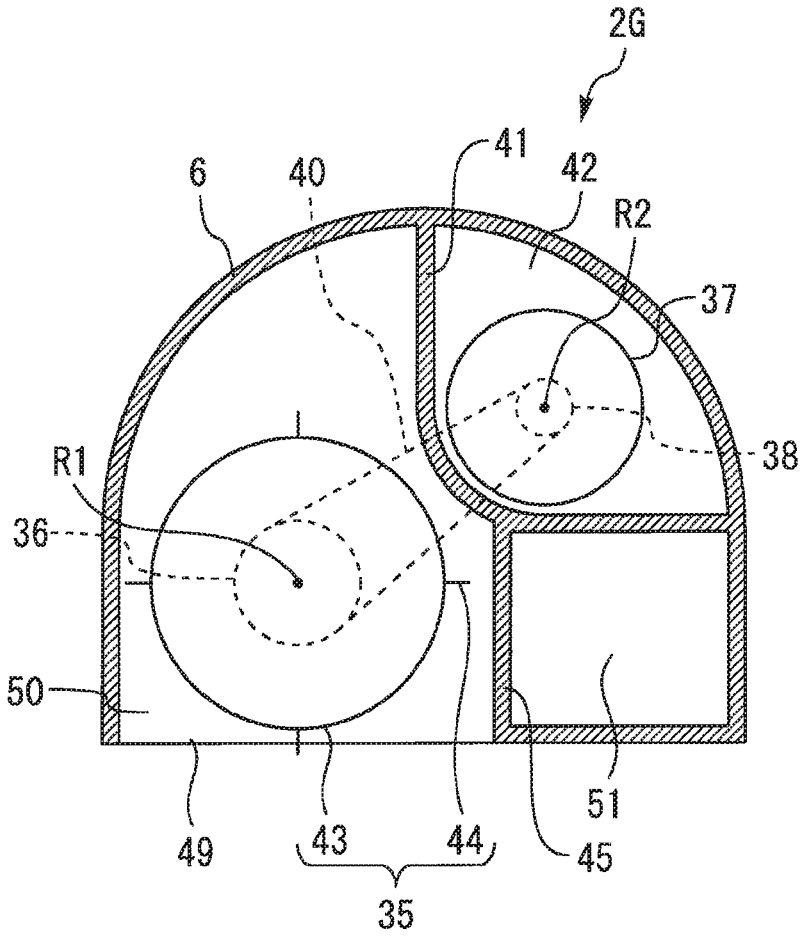
FIG. 25 is a cross-sectional side view of a cleaner head according to a ninth embodiment.

Next, while a ninth embodiment will be described with reference to FIG. 25, the description will focus on differences from the first embodiment described above and descriptions of same or equivalent portions will be simplified or omitted. FIG. 25 is a cross-sectional side view of a cleaner head 20 according to the ninth embodiment. A bottom view of the cleaner head 2G according to the ninth embodiment is approximately the same as FIG. 18 and thus will be omitted. FIG. 25 is a cross-sectional view, cut at a position corresponding to the line G-G in FIG. 18, of the cleaner head 2G according to the ninth embodiment.

The cleaner head 2G according to the present ninth embodiment is configured as follows. The motor 37 is arranged at a position closer to the distal end 62 than to the proximal end 61 of the body 6. The axis of rotation R2 of the motor 37 is substantially parallel to the axis of rotation R1 of the agitator 35. As shown in FIG. 25, when viewed from a direction parallel to the longitudinal direction of the body 6, the axis of rotation R2 of the motor 37 is positioned obliquely above the axis of rotation R1 of the agitator 35. The body 6 includes a bulkhead 41 and a motor chamber 42. The motor chamber 42 houses the motor 37. The bulkhead 41 separates the motor chamber 42 and the agitator chamber 50 from each other and separates the motor chamber 42 and the second suction channel 51 from each other. The motor 37 is at least partially positioned above the second suction channel 51.

With the present ninth embodiment, the following effects are produced. By arranging the motor 37 at a position closer to the distal end 62 than to the proximal end 61 of the body 6, an influence of an arrangement of the motor 37 on a shape of a suction channel near the joint 7 can be prevented. The shape of the suction channel near the joint 7 can be readily and favorably formed. Since the motor 37 can be arranged at a distant position from a flow of dirty air toward the joint 7, less dust enters the motor 37. The motor 37 can be cooled more readily. Service life of the motor 37 can be extended. Since a rotational speed of the agitator 35 can be improved, dust removing performance is improved. By arranging the axis of rotation R2 of the motor 37 at a position that is obliquely above the axis of rotation R1 of the agitator 35, downsizing of the body 6 in the width direction and the height direction can be achieved.

REFERENCE SIGNS LIST

1, 1A Vacuum cleaner
2, 2A, 2B, 2C, 2D, 2E, 2F, 2G Cleaner head
3 Connection pipe
4 Suction hose
5, 5A Cleaner main body
6 Body
7 Joint
7*a* First section
76 Second section
8 Suction pipe
9, 9A Handle
10 Operation switch
11 Hose connection port
12 Power cord
13 Wheel
14, 14A Housing unit
15, 15A Dust collecting unit
16, 17 Housing body
18 First connection port
19 Second connection port
20 Suction air channel-forming portion
21 Suction air channel
22 Exhaust air channel-forming portion
23 Exhaust air channel
24 Electric air blower
31 Upper case
32 Lower case
34 Bulkhead
35 Agitator
36 Driven wheel
37 Motor
38 Driving shaft
39 Motor chamber
40 Driving belt
41 Bulkhead
42 Motor chamber
43 Cylindrical substrate
44 Protruding member
45 Bulkhead
46 Air vent
47 Roller
48 Shaft
49 Suction opening
50 Agitator chamber
51 Second suction channel
52 Bulkhead
53 Opening
54 Agitator introduction/removal port

55 Plug
56 Intermediate gear
57 Motor
58 Fixed shaft
59 Third suction channel
61 Proximal end
62 Distal and
71 First suction channel
571 Outer rotor
572 Inner stator

The invention claimed is:

1. A cleaner head for a vacuum cleaner, comprising:

a body having a proximal end and a distal end, a length from the proximal end to the distal end being longer than a width perpendicular to a longitudinal direction from the proximal end toward the distal end;

an agitator rotatably mounted relative to the body, an axis of rotation of the agitator being substantially parallel to the longitudinal direction;

a motor configured to rotate the agitator;

a suction pipe; and a joint having a first suction channel in communication with an inside of the suction pipe, the joint being configured to turnably connect the suction pipe to the body, the joint being located closer to the proximal end than to the distal end, the body including an agitator chamber housing the agitator, a second suction channel in communication with the first suction channel, and a bulkhead separating the agitator chamber from the second suction channel, the second suction channel extending substantially parallel to the axis of rotation of the agitator, the bulkhead having at least one air vent from the agitator chamber to the second suction channel, a position of an inner wall surface in an upper part of the second suction channel is lower than an upper end of the agitator.

2. The cleaner head according to claim 1, wherein the at least one air vent includes an air vent positioned at the center of a length of the agitator in the longitudinal direction or an air vent positioned to be biased toward a side of the distal end with respect to the center of the length of the agitator in the longitudinal direction.

3. The cleaner head according to claim 1, wherein the motor is positioned closer to the distal end than to the proximal end.

4. The cleaner head according to claim 1, wherein the motor is positioned closer to the proximal end than to the distal end, and a distance between an axis of rotation of the motor and a bottom surface of the body is greater than a distance between the axis of rotation of the agitator and the bottom surface of the body.

5. The cleaner head according to claim 1, wherein the axis of rotation of the motor is substantially parallel to the axis of rotation of the agitator.

6. The cleaner head according to of claim 1, wherein the axis of rotation of the motor is either substantially parallel to the axis of rotation of the agitator or coaxial with the axis of rotation of the agitator, and when viewed in a direction parallel to the axis of rotation of the agitator, an outer circumference of the motor is inside an outer circumference of the agitator.

7. The cleaner head according to claim 1, wherein the motor is an outer rotor-type motor arranged inside the agitator.

8. The cleaner head according to claim 1, wherein the body includes an agitator introduction/removal port connected to an end surface of the distal end from the agitator chamber, and the agitator can be removed from the body through the agitator introduction/removal port.

9. The cleaner head according to claim 1, comprising a roller in a lower part of the body.

10. The cleaner head according to claim 1, wherein the joint includes a first section connected to the body so as to be turnable around a first pivot axis, and a second section connected to the first section so as to be turnable around a second pivot axis, the second pivot axis being not parallel to the first pivot axis.

11. The cleaner head according to claim 10, wherein one of the first pivot axis and the second pivot axis is substantially parallel to the longitudinal direction, and the second pivot axis is substantially perpendicular to the first pivot axis.

12. The cleaner head according to claim 1, wherein the joint is connected to an end surface of the proximal end.

13. The cleaner head according to claim 1, wherein in a plan view, a connection portion between the joint and the end surface of the proximal end is positioned substantially at the center of the width of the body.

14. A vacuum cleaner comprising the cleaner head according to claim 1.

* * * * *